United States Patent [19]

Katoh et al.

[11] Patent Number: 4,719,833

[45] Date of Patent: Jan. 19, 1988

[54] TONE SIGNAL GENERATION DEVICE WITH INTERPOLATION OF SAMPLE POINTS

[75] Inventors: Mitsumi Katoh; Tokuji Hayakawa, both of Hamamatsu, Japan

[73] Assignee: Nippon Gakki Seizo Kabushiki Kaisha, Hamamatsu, Japan

[21] Appl. No.: 850,287

[22] Filed: Apr. 10, 1986

[51] Int. Cl.[4] ..... G10H 7/00

[52] U.S. Cl. ..... 84/1.01; 84/1.28; 364/419; 364/723

[58] Field of Search ..... 84/1.01; 364/419, 718, 364/723; 381/51

[56] References Cited

U.S. PATENT DOCUMENTS

| | | | |
|---|---|---|---|
| 4,036,096 | 7/1977 | Tomisawa et al. . | |
| 4,205,575 | 6/1980 | Hoskinson et al. | 84/1.01 |
| 4,409,876 | 10/1983 | Katoh | 84/1.01 |
| 4,479,411 | 10/1984 | Ishibashi | 84/1.01 |
| 4,536,853 | 8/1985 | Kawamoto et al. | 84/1.01 X |
| 4,561,337 | 12/1985 | Wachi | 84/1.01 |
| 4,619,174 | 10/1986 | Okumura . | |
| 4,633,749 | 1/1987 | Fujimori et al. . | |

FOREIGN PATENT DOCUMENTS

| | | |
|---|---|---|
| 57-171395 | 10/1982 | Japan . |
| 60-147793 | 8/1985 | Japan . |

*Primary Examiner*—S. J. Witkowski

*Attorney, Agent, or Firm*—Spensley Horn Jubas & Lubitz

[57] ABSTRACT

A note clock generation circuit generates note clock pulses in correspondence to a note name of a tone to be generated. An octave rate data generation circuit generates rate data in correspondence to the octave range to which the tone to be generated belongs. By performing addition or subtraction of the rate data at the timing of generation of the note clock pulses, an address signal is generated. A tone generator generates a tone waveshape in the form of amplitude sampled values in response to an integer section of this address signal. An interpolation circuit performs interpolation between adjacent amplitude sampled values thus generated in response to a decimal section of the address signal. The rate of change of the decimal section of the address signal is changed in accordance with the tone range so that a finer interpolation is made as the tone range becomes lower. By this arrangement, decrease in an effective sampling frequency in the lower tone range can be prevented. The interpolation circuit receives the amplitude sampled values and the interpolation parameter (i.e., the decimal section of the address signal) respectively in a pitch synchronized state and performs the interpolation operation in the pitch synchronized state. The timing of the interpolation operation thereby is synchronized with the pitch of the generated tone so that inharmonic noise components are substantially removed.

13 Claims, 21 Drawing Figures

ADDRESS SIGNAL GENERATION CKT. 16

INTERPOLATION CKT. 63

TONE SIGNAL GENERATION DEVICE WITH INTERPOLATION OF SAMPLE POINTS

BACKGROUND OF THE INVENTION

This invention relates to a tone signal generation device and, more particularly, to a device capable of performing an interpolation between amplitudes of tone waveshape sample points in accordance with a tone range of a tone to be generated. The invention relates also to a tone signal generation device in which waveshape resolution has been improved by interpolating amplitudes of tone waveshape sample points and inharmonic noise has been removed by having the sampling frequency synchronized with the pitch of the tone.

A typical method for generating a tone waveshape sample point amplitude signal on the basis of phase information which changes with the pitch of a tone to be generated is to store a tone waveshape divided in a specific number of sample points in a memory and have this waveshape read out in response to phase information. If reading of tone waveshapes of the same note name in different octaves is considered, the amount of phase change per one sampling time becomes larger as the octave is higher and smaller as the octave is lower. For this reason, in reading out a tone waveshape of a relatively low tone range, it happens that an amplitude value of the same sample point is repeatedly read out over plural sampling times. This means that an effective sampling frequency decreases by an amount corresponding to the same sample point amplitude value which has been repeatedly read out. If, for example, different sample point amplitude values are read out in response to a sampling clock pulse of a frequency fs, the effective sampling frequency in the read out tone waveshape signal is fs but if the same sample point amplitude value is read out twice in succession, the effective sampling frequency of the read out tone waveshape signal decreases to fs/2. The term "effective sampling frequency" herein means a frequency at which the sample point amplitude value actually changes in an obtained tone waveshape signal.

In a case where the effective sampling frequency has decreased as described above, the actual sampling frequency decreases no matter how high the nominal sampling frequency (i.e., frequency of the sampling clock pulse) may be and, accordingly, a tone range in which an aliasing noise occurs becomes lower with an increasing tendency to generation of such aliasing noise. This is not a sole problem of the above described system of the waveshape memory accessing type but can take place in any tone waveshape sample point amplitude signal generation system.

On the other hand, known in the art is a system according to which sampling of a higher resolution can be realized by interpolating respective sample points of a tone waveshape sample point amplitude signal which has once been generated. For example, U.S. Pat. No. 4,036,096 discloses a system according to which finer interpolation between sample points is effected as the tone range of a tone to be generated becomes higher whereby a tone waveshape in a higher tone range can be made a smooth waveshape with little harmonic content and an aliasing noise in the higher tone range can be eliminated. It was not an object of this prior art system, however, to solve the problem of decreasing in the effective sampling frequency in a lower tone range and resulting generation of an aliasing noise in the lower tone range and so the prior art system cannot solve this problem at all.

In an electronic musical instrument of a digital processing type, a tone waveshape is synthesized by sampling tone waveshape amplitudes at a predetermined sampling interval. For synthesizing a tone waveshape by sampling, there have been practiced two methods. One is to perform sampling always at a constant sampling frequency regardless of the frequency of a tone to be synthesized and the other is to have the sampling frequency synchronized with the frequency of a tone to be synthesized. In the former, since the ratio between a tone frequency and a sampling frequency is a noninteger ratio, an aliasing noise which is not harmonic to the tone frequency is generated as will be apparent from the sampling theorem. In the latter, the tone frequency (pitch) is harmonized with the sampling frequency so that a component which is generated by aliasing is harmonized with the tone frequency and thereby is prevented from becoming a noise. Japanese Preliminary Patent Publication No. 171395/1982 discloses an art in which, in a system generating tone signals in plural channels on a time shared basis, the pitch of a tone signal generated in each channel is caused to synchronize with the sampling frequency. The above mentioned U.S. Pat. No. 4,036,096 discloses a system in which waveshape resolution is improved by interpolating amplitudes of sample points of a generated waveshape signal.

The system interpolating sample point amplitude values of a tone waveshape signal is advantageous in that a quality of a generated tone can be improved with a relatively simple construction. The interpolation performed in the prior art interpolation technique, however, is not synchronized with the pitch of a tone and there arises the problem that a component of interpolation operation timing becomes a noise with respect to a generated tone.

SUMMARY OF THE INVENTION

It is, therefore, an object of the present invention to provide a tone signal generation device capable of solving the above described problems and being capable of preventing decrease in the effective sampling frequency in a lower tone range and thereby eliminating occurence of an aliasing noise.

It is another object of the invention to provide a tone signal generation device of a type in which a tone signal generation circuit is simplified by generating tone signals in plural channels on a time shared basis which device is capable of solving the problem of occurrence of an aliasing noise by causing the pitch of a tone signal generated in each channel and the sampling frequency to be synchronized with each other, improving the quality of the generated tone by interpolating tone waveshape sample point amplitudes and eliminating inharmonic noise which tends to occur due to interpolation by performing such interpolation at a timing synchronized with the pitch of the generated tone.

A tone signal generation device achieving the first object of the invention is characterized in that it comprises phase information generation means for generating phase information representing a progressive phase of a tone signal to be generated and different according to a tone pitch of said tone signal, waveshape generation means for generating a tone waveshape in the form of amplitude sampled values in response to said phase information, and interpolation means for interpolating at least two of said amplitude sampled values and for outputting an interpolated result as a new sampled value constituting said tone signal, said interpolation means performing a finer interpolation as said tone pitch becomes lower.

The interpolation means preferably performs an interpolation operation only when said tone pitch is lower than a predetermined reference tone pitch. For example, an interpolation information may be generated when the tone range of the tone to be generated is lower than a predetermined reference tone range. This interpolation information may be one in which the number of interpolation steps is determined in accordance with the tone range, this step number increasing as the tone range becomes lower. In this case, the tone range should preferably be determined by octave unit for simplifying various processings but the tone range need not necessarily be determined by octave unit but it may be determined by, for example, two octave unit or half octave unit.

In another aspect of the invention, the tone signal generation device is characterized in that it comprises note clock generation means for generating note clock pulses corresponding to note name of a tone signal to be generated, rate data generation means for generating rate data whose value corresponds to a tone range to which said tone signal belongs, address signal generation means for generating an address signal formed by performing processing of said rate data at the timning of generation of said note clock pulse, and waveshape generation means for generating a tone waveshape in the form of amplitude sampled values in response to an integer section of said address signal. The tone signal generation device preferably further comprises interpolation means for interpolating at least two of said amplitude sampled values in accordance with a decimal section of said address signal.

Interpolation information corresponding to a tone range of a tone to be generated is generated in the interpolation means and, responsive to this interpolation information, amplitudes between tone wavehape sample points are interpolated in the interpolation means. By performing of the interpolation, the number of sample points is substantially increased by the number corresponding to the interpolation step number. Accordingly, by performing such interpolation in accordance with the tone range in a desired lower tone range, the effective sampling frequency can be increased and the problem of occurrence of aliasing noise thereby can be solved.

This will be explained with reference to FIGS. 10(*a*)–(*e*). In FIG. 10(*a*) is an example of a part of tone waveshape sample point amplitude in a predetermined reference octave. The effective sampling frequency of this tone waveshape is designated by fs. FIG. 10(*b*) is an example of a tone waveshape sample point amplitude one octave below the reference octave. This is a state before interpolation is made and, if the sampling time of FIG. 10(*a*) is one sampling time, the amplitude value of the same sample point continues for two sampling times. Its effective sampling frequency therefore is fs/2. FIG. 10(*c*) is an example of a tone waveshape sample point amplitude in a case where the sample points of FIG. 10(*b*) are interpolated by two steps. In this case, the amplitude value changes at each sample point. Its effective sampling frequency therefore is fs. FIG. 10(*d*) is an example of a tone waveshape sample point amplitude two octaves below the reference octave in a state before interpolation is made and FIG. 10(*e*) is an example of the tone waveshape sample point amplitude two octaves below after interpolation has been performed. The effective sampling frequency of FIG. 10(*d*) is fs/4. The effective sampling frequency of FIG. 10(*e*) is fs because in FIG. 10(*e*), the sample points of FIG. 10(*d*) are interpolated by four steps. It will be understood that FIG. 10(*c*) and FIG. 10(*e*) show examples of the interpolation made according to the invention according to which the effective sampling frequency is increased in a lower tone range in such a manner that, for example, the effective sampling frequency can be made common throughout all tone ranges.

In another aspect of the invention, a decimal section of the address signal generated by the address signal generation means is utilized as an interpolation parameter. This address signal is a sum or difference of addition or subtraction of numerical data corresponding to the octave range and the address signal contains a decimal section if the numerical data contains a decimal section. Therefore, by causing the numerical data to contain a decimal section in accordance with the octave range, interpolation can be performed in accordance with the tone range of a tone to be generated in the same manner as described above. The octave range in this case also is not limited to one octave unit but may be two octave unit etc.

A tone signal generation device achieving the second object of the invention is characterized in that it comprises tone generation means for generating tone waveshape sample point amplitude signals in plural channels on a time shared basis, pitch synchronizing means for synchronizing timing of change of the tone waveshape sample point amplitude signal generated in each channel with the pitch of a tone to be generated, and interpolation means for interpolating the tone wacveshape sample point amplitude signal of each channel having been synchronized by said pitch synchronizing means between at least two sample points in the same channel at a timing synchronized with the pitch of the tone to be generated in the channel.

By the pitch synchronizing means, the sampling frequency of the tone waveshape sample point amplitude signal generated in each channel is synchronized with the pitch of the tone. The tone waveshape sample point amplitude signal having the sampling frequency synchronized with the pitch is applied to the interpolation means and the interpolation are performed at a timing synchronized with the pitch of the tone to be generated. Accordingly, the interpolation operation timing is synchronized with the pitch of the tone to be generated whereby the cause for occurrence of an inharmonic noise is removed.

Embodiments of the invention will now be described with reference to the accompanying drawings.

BRIEF DESCRIPTION OF THE DRAWINGS

In the accompanying drawings.

DESCRIPTION OF PREFERRED EMBODIMENTS

Description of the Entire Construction of One Embodiment

Figure 1:
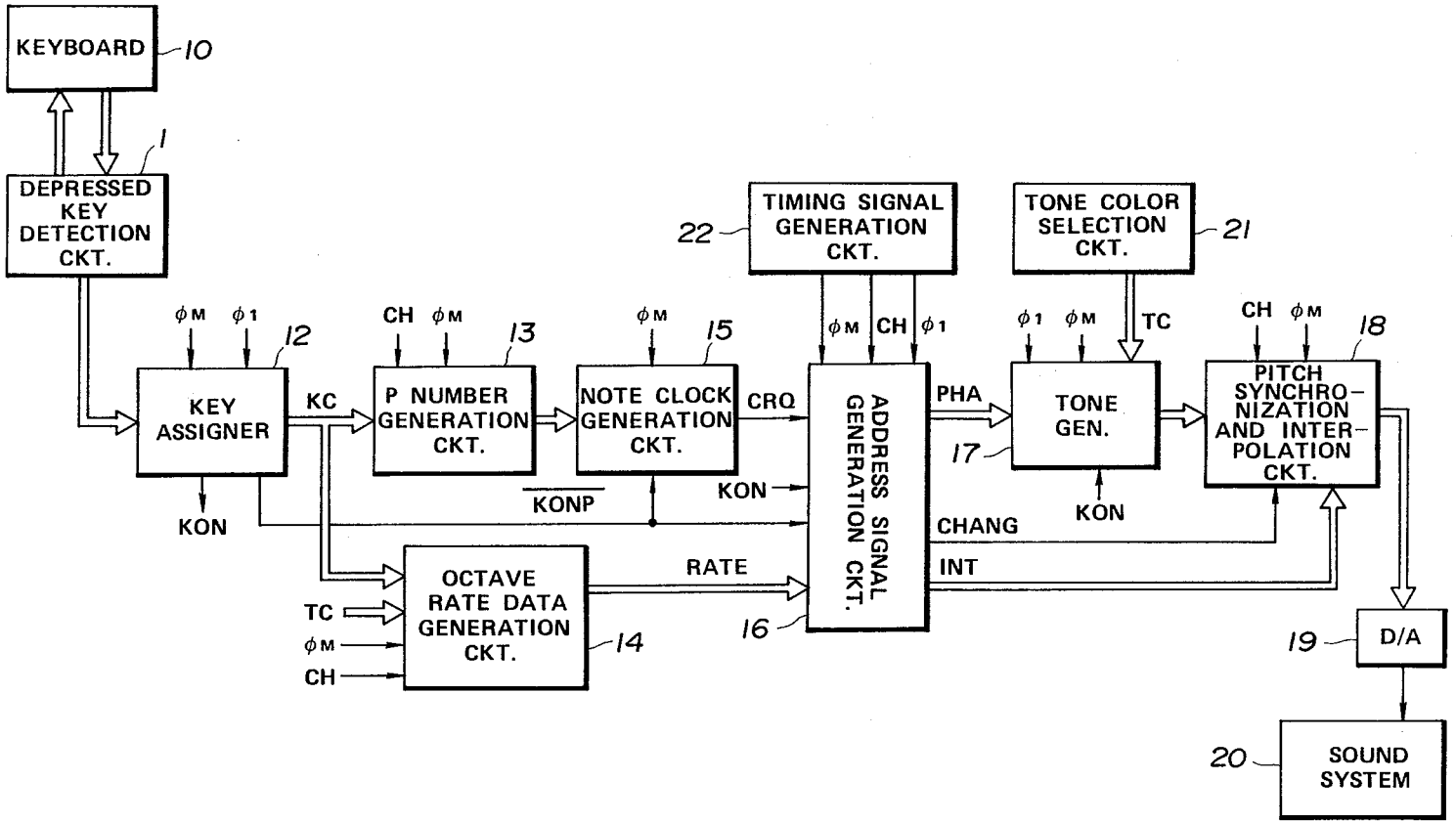
FIG. 1 is a block diagram showing an entire construction of an embodiment of an electronic musical instrument incorporating the device made according to the invention.

Referring to FIG. 1, a keyboard 10 has keys for designating tone pitches of tones to be generated. A depressed key detection circuit 11 detects depression and release of a key in the keyboard 10 and provides a signal corresponding to the depressed or released key to a key assigner 12. The key assigner 12 is a circuit provided for assigning generation of a tone corresponding to the depressed key to any available one of a plurality of tone generation channels. At each time division timing corresponding to each channel, the key assigner 12 generates a key code KC representing a key assigned to the particular channel and a key-on signal KON representing whether the key is still being depressed or not.

The key code KC is supplied to a P number generation circuit 13 and an octave rate data generation circuit 14. The P number generation circuit 13 generates a P number which has a value corresponding to the note name of the applied key code KC (i.e., the note name of the tone to be generated). The P number will be described fully later. The octave rate data generation circuit 14 generates numerical data corresponding to the octave of the tone to be generated, i.e., an octave rate data RATE in response to the applied key code KC. The range of one octave herein is not necessarily limited to one octave range from the note name C but it may be one octave range from any note name. As will become apparent from description to follow, this octave rate data generation circuit 14 functions as interpolation information generation means with respect to an octave which is lower than a reference octave. In other words, numerical data corresponding to an octave lower than the reference octave, i.e., the rate data RATE, functions as interpolation information corresponding to that octave.

A note clock generation circuit 15 generates note clock pulses having a frequency corresponding to the note name of the tone to be generated in response to a P number supplied by the P number generation circuit 13. Since this note clock pulse functions as a signal requesting an address signal generation circuit 16 to change an address signal by adding (or subracting) the rate data RATE, this clock pulse will hereinafter be referred to as an address change request signal CRQ.

The address signal generation circuit 16 generates an address signal by adding (or subtracting) the rate data RATE when the address change request signal CRQ has been provided. Accordingly, the address signal successively increases (or decreases) by a value of the rate data RATE (i.e., numerical value corresponding to the octave) at each timing when the address change request signal CRQ has been given (i.e., at each timing when the note clock pulse has been generated). As is well known, the address signal repeats increase (or decrease) by a predetermined modulo number.

The address signal generated by the address signal generation circuit 16 can be divided into an integer section and a decimal section. The integer section is supplied to a tone generator 17 as a phase address signal PHA designating a sample point order, i.e., phase, of a tone waveshape sample point amplitude signal to be generated by the tone generator 17 whereas the decimal section is supplied to a pitch synchronization and interpolation circuit 18 as interpolation address data INT designating an interpolation address. In the case of linear interpolation, the interpolation address data INT can be used directly as an interpolation coefficient.

The pitch synchronization and interpolation circuit 18 performs resampling of the tone waveshape sample point amplitude signal generated by the tone generator 17 in synchronization with its tone pitch, i.e., pitch (this operation will hereinafter be called "pitch synchronization operation") and also interpolating the pitch synchronized tone waveshape sample point signal between adjacent sample points (i.e., between adjacent addresses in the integer section) in response to the interpolation address data INT.

The octave rate data RATE consists of an integer section and a decimal section. It is data of the decimal section that functions as the above described interpolation information. The decimal section of the address signal, i.e., the interpolation address data INT, is obtained by computing the decimal section of this rate data RATE. As will become apparent from description to follow, the octave rate data RATE has a value in the decimal section when the octave of the tone to be generated is lower than the reference octave and has no such value in the decimal section when the octave is higher than the reference octave. Accordingly, when the octave of the tone to be generated is lower than the reference octave, the interpolation address data INT is generated and interpolation is performed in the interpolation circuit 18 whereas when the octave is higher than the reference octave, the interpolation address data INT is not generated and no interpolation is performed.

The tone signal produced by the pitch synchronization and interpolation circuit 18 is converted to an analog signal by a digital-to-analog conversion circuit 19 and thereafter supplied to a sound system 20. A tone color selection circuit 21 is provided for selecting a tone color of the tone to be generated and supplies tone color information TC representing the selected tone color to other circuits. The operations of the respective circuits from the key assigner to the pitch synchronization and interpolation circuit 18 for respective channels are performed on a time shared basis. A timing signal generation circuit 22 generates various timing signals used for controlling time division operations of the respective circuits and also a master clock pulse $\phi_M$ and other clock pulses.

In the embodiment shown in FIG. 1, a special arrangement is made in relation to the above described pitch synchronization operation and a time division operation speed.

A note clock generation circuit 15 is provided for the pitch synchronization. This circuit 15 generates a note clock pulse, i.e., the address change request signal CRQ, having a frequency corresponding to the note name of the tone to be generated. By changing the address signal in accordance with the timing of generation of this address change request signal CRQ, an effective sampling frequency of the tone waveshape signal which is generated in accordance with this address signal is harmonized with the pitch of the tone waveshape signal whereby the pitch synchronization is effected. As will become apparent later, however, the pitch synchronization in this embodiment is not effected in the stage of the address signal generation circuit 16 and the tone generator 17 but effected in the pitch synchronization and interpolation circuit 18. Reverting to the note clock generation circuit 15, this circuit 15 must generate, for respective channels on a time shared basis, note clock pulses corresponding to various note names in response to the common master clock pulse $\phi_M$. Besides, it is desirable that the frequencies of the note clock pulses be relatively high for ensuring high precision of the pitch synchronization. The note clock generation circuit 15 therefore is required to operate at a time division timing of a relatively high speed. The pitch synchronization and interpolation circuit 18 realizing the pitch synchronization also is required to operate at a time division timing of a speed which is as high as that of the note clock pulses. On the other hand, the key assigner 12 and the tone generator 17 are not required to operate at a time division timing of such a high speed but it is rather preferable for the circuit design and the tone generation computation processings that these circuits operate at a relatively low time division speed.

In the present embodiment, therefore, an arrangement is made so that necessary circuits are operated at two time division operation speeds, i.e., a high speed and a low speed. More specifically, the key assigner 12 and the tone generator 17 perform time division processings for the respective channels at the low speed whereas the note clock generation circuit 15 and the pitch synchronization and interpolation circuit 18 perform time division processings for the respective channels at the high speed. The output of the key assinger 12 is produced at the time division timing of the low speed. Since, however, the note clock generation circuit 15 operates at the high speed time division timing, means for converting the time division speed of the signal from the low speed to the high speed is provided in the P number generation circuit 13. Since the output CRQ of the note clock generation circuit 15 is also a signal of the high speed time division timing, means for converting the time division speed of the signal from the low speed to the high speed is provided also in the octave rate data generation circuit 14 for producing the rate data RATE at the high speed time division timing in synchronization with the output CRQ.

While the address signal generation circuit 16 must generate the address signal in accordance with the address change request signal CRQ and the rate data RATE which are both signals of the high speed time division timing, the tone generator 17 which uses this address signal (particularly its integer section) is operated at the low speed time division timing. Accordingly, means for converting the time division speed of the signal from the high speed to the low speed is provided in the address signal generation circuit 16 so that at least the integer section of the address signal, i.e., the phase address signal PHA, is generated at the low speed time division timing. The pitch synchronization operation in the pitch synchronization and interpolation circuit 18 must be performed at the time division timing of a speed which is as high as that of the note clock pulses, i.e., the address change request signal CRQ and the interpolation operation in this circuit 18 must also be performed at the high speed time division timing for realizing interpolation without impairing the pitch synchronized state. In the circuit 18, therefore, means is provided for converting the tone waveshape sample point amplitude signal of the low speed time division timing to the one of the high speed time division timing. Since the interpolation operation is performed at the high speed time division timing, the interpolation address data INT generated by the address signal generation circuit 16 may remain the signal of the high speed time division timing.

Description will now be made about specific examples of the respective circuits shown in FIG. 1.

Description of the Time Division Timing

Examples of the low speed and high speed time division timings will be explained with reference to FIGS. 2(*a*)–(*h*).

The high speed time division timing is formed by using one period of the master clock pulse $\phi_M$ as one time slot. If, for example, there are four tone generation channels, time slots, i.e., high speed channel timings, for the first to fourth channels in the high speed time division timing are shown in FIG. 2(*b*). The sampling period of a tone in the high speed time division timing, therefore, is four times as long as the master clock pulse $\phi_M$. FIG. 2(*d*) shows a low speed clock pulse having a period which is sixteen times as long as the master clock pulse $\phi_M$. The low speed time division timing is formed by using one period of this low speed clock pulse as one time slot. FIG. 2(*e*) shows names of channels of the key codes KC provided by the key assigner 12 shown in FIG. 1 in accordance with this low speed time division timing. FIG. 2(*c*) shows a channel synchronizing pulse CH which is used for converting the time division speed of the signal from the low speed to the high one or vice versa. This pulse CH consists of four pulses in total which are respectively generated once at the high speed time division timings of the respective channels 1–4 during 64 $\phi_M$ (64 periods of the master clock pulse $\phi_M$) in which the low speed channel timing completes one cycle. For example, one shot of pulse is generated at the high speed time division timing of the channel 1, another shot of pulse is generated 17 $\phi_M$ (17 periods of the master clock pulse $\phi_M$) later at the high speed time division timing of the channel 2, another shot of pulse is generated 17 $\phi_M$ later at the high speed time division timing of the channel 3, another shot of pulse is generated 17 $\phi_M$ later at the high speed time division timing of the channels 4 and still another shot of pulse is generated reverting to the high speed time division timing of the channel 1 which is 13 $\phi_M$ (13 periods of the master clock pulses $\phi_M$) later. FIG. 2(*f*) shows timing of generation of an inverted key-on pulse $\overline{\text{KONP}}$. This pulse $\overline{\text{KONP}}$ normally is a signal "1" and, when a newly depressed key has been assigned to a certain channel, is turned to a signal "0" only once at a timing of generation of the channel synchronizing pulse CH corresponding to this channel.

Description about P Number

The P number means a number indicating a number of sample points in one period of a tone waveshape having a frequency corresponding to the respective note names C–B in a certain reference octave. For enabling generation of plural tones of desired note names on a time shared basis, a common basic sampling frequency is employed for all note names, this basic sampling frequency having a period which is four times as long as the master clock pulse as described previously. Since, on the other hand, the basic sampling frequency is common, the P number of each note name has a value corresponding to its frequency which is different from other note names. If the frequency of a certain note name in the reference octave is designated by fn and the common sampling frequency by fc, the P number corresponding to this note name is determined in the following manner:

$$\text{P number} = fc \div fn \quad (1)$$

Assuming now that the common sampling frequency fc is fc=785.54 kHz and the frequency fn of note name A is fn=440 Hz (i.e., A4 tone), the P number of this note name A is calculated from the above equation becomes $$\text{P number of note name A} = 785{,}540 \div 440 = 1785.$$

In the meanwhile, assuming that the sample point number of different sample point amplitude values for one period of a tone waveshape capable of being generated in the tone generator 17 is 64, effective sampling frequency fe of the frequency fn becomes $$fe = fn \times 64 \quad (2)$$

and, in case of fn=440 Hz, the effective sampling frequency fe becomes $$fe = 440 \times 64 = 28{,}160 \text{ Hz}.$$

Similarly, P numbers and effective sampling frequencies fe of the reference octave can be determined as in the following Table 1. In this example, the reference octave ranges over one octave from G4 to F#5.

TABLE 1

| note name | pitch (Hz) | effective sampling frequency (kHz) | P number |
|---|---|---|---|
| G4 | 392.0 | 25.088 | 2004 |
| G#4 | 415.3 | 26.580 | 1891 |
| A4 | 440.0 | 28.160 | 1785 |
| A#4 | 466.2 | 29.834 | 1685 |
| B4 | 493.9 | 31.609 | 1590 |
| C5 | 523.3 | 33.488 | 1501 |
| C#5 | 554.4 | 35.479 | 1417 |
| D5 | 587.3 | 37.589 | 1337 |
| D#5 | 622.3 | 39.824 | 1262 |
| E5 | 659.3 | 42.192 | 1192 |
| F5 | 698.5 | 44.701 | 1125 |
| F#5 | 740.0 | 47.359 | 1062 |

Description of the Note Clock Pulse

In the note clock generation circuit 15 (FIG. 1), the note clock pulse, i.e., the address change request signal CRQ, is obtained by frequency-dividing the common sampling frequency fc established on the basis of the master clock pulse $\phi_M$ in accordance with the P number. As will be apparent from the above description, the P number is the number of periods of the common sampling frequency fc, i.e., the number of sample points, in one period of the waveshape whereas the effective sample point number for one period of the tone waveshape which can be generated in the tone generator 17 is 64 as described previously. Accordingly, if a frequency dividing number used for frequency-dividing the common sampling frequency fc is $$\text{frequency dividing number} = \text{P number} \div 64 \quad (3),$$

64 pulses can be produced for each period as the frequency-divided output whereby 64 effective sample points can all be established. By frequency-dividing the common sampling frequency fc by the frequency dividing number determined in this manner, the following equation is derived from the above equations (1), (2) and (3):

$$fc \div \text{frequency dividing number} = (fn \times \text{P number}) \div (\text{P number} \div 64) = fn \times 64 = fe \quad (4).$$

By changing the sample point address by this frequency-divided output, the effective sampling frequency fe can be established. The effective sampling frequency fe thus established is harmonized with the note name frequency fn so that the pitch synchronization is realized. The note clock pulse, i.e., the address change request signal CRQ, generated by the note clock generation circuit 15 is a signal having the frequency-divided output as shown in the above equation (4), i.e., the effective sampling frequency fe.

The frequency dividing number determined by the equation (3) is not necessarily an integer but it frequently includes a decimal. In the case of the note name A, for example, $$\text{frequency dividing number} = 1785 \div 64 = 27.89.$$

For this reason, the frequency dividing operation in the note clock generation circuit 15 is made, as described below, by using two integers which are proximate to the frequency dividing number determined by the equation (3) and thereby obtaining, as an averaging result, the same result as if the common sampling frequency was frequency-divided by the frequency dividing number determined by the equation (3).

Description of Specific Examples of the P Number Generation Circuit 13 and the Note Clock Generation Circuit 15

Figure 2:
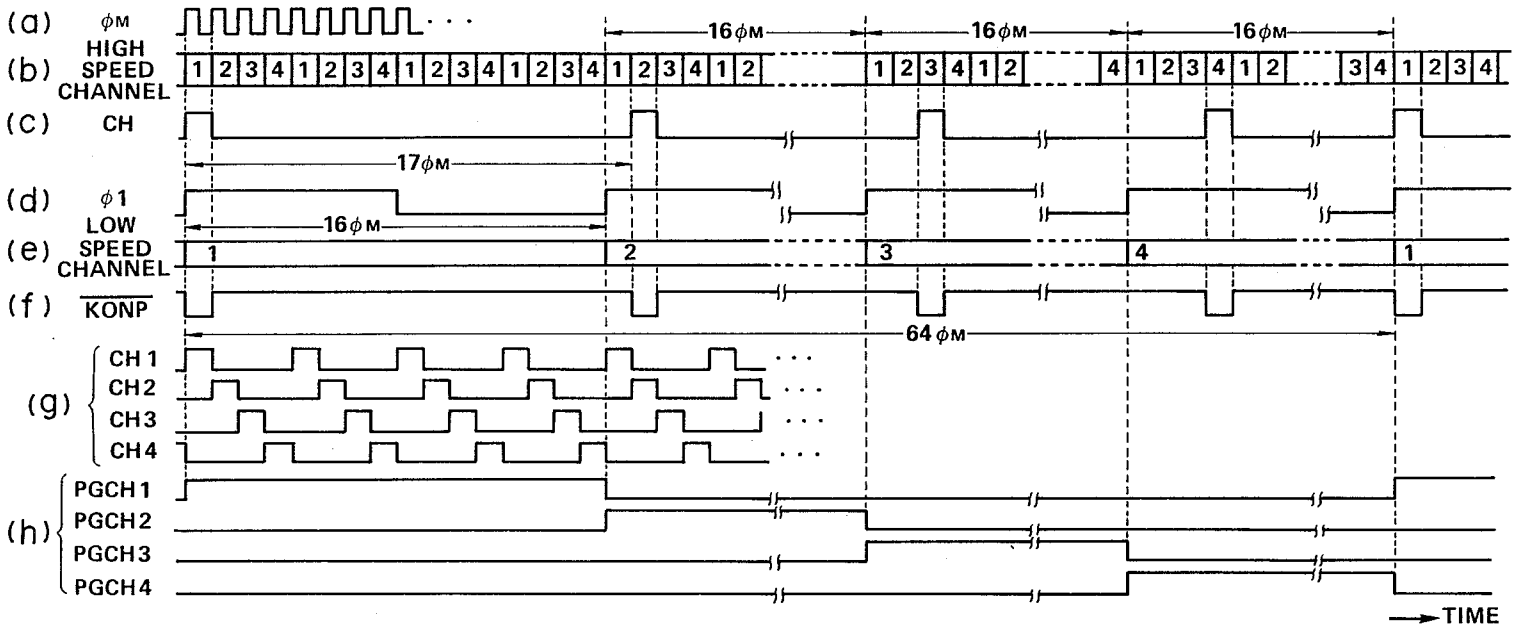
FIGS. 2(*a*)–(*h*) are time charts of timing signals for showing an example of a channel time division timing.
Figure 3:
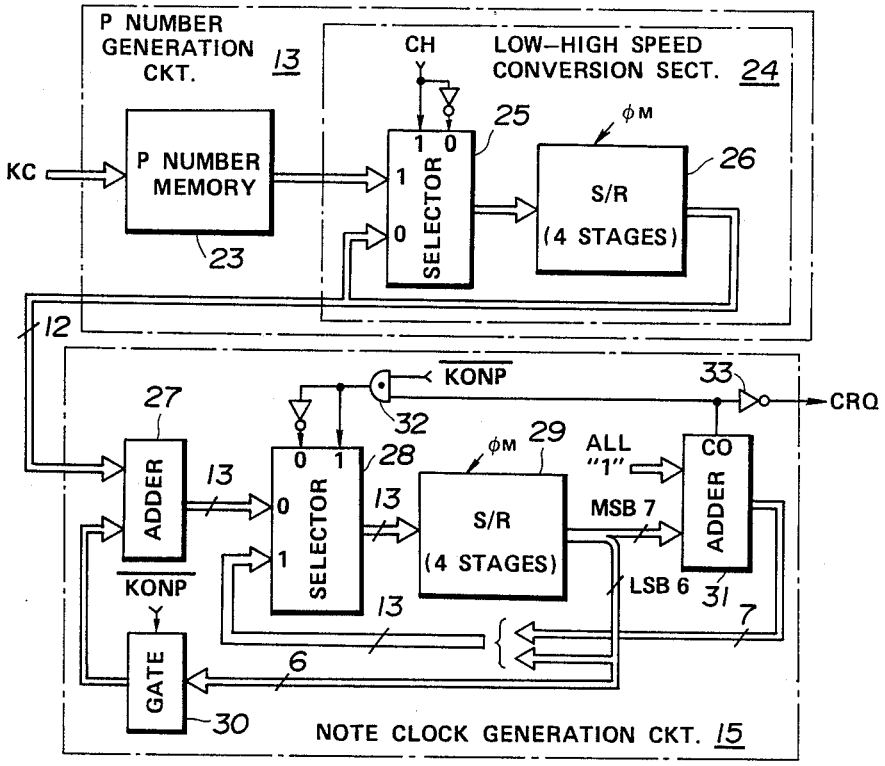
FIG. 3 is a block diagram showing a specific example of a P number generation circuit and a note clock generation circuit in FIG. 1.

In FIG. 3, the P number generation circuit 13 comprises a P number memory 23 prestoring P numbers of respective note names in the reference octave as shown in the above listed Table 1 and a low-high speed conversion section 24. The low-high speed conversion section 24 comprises a selector 25 in which the output of the P number memory 23 is applied to its input "1" and a shift register 26 of four stages corresponding to the four channels, the output of the shift register 26 being circulated through a "0" input of the selector 25. The channel synchronizing pulse CH (FIG. 2(*c*)) is applied as a selection control signal in the selector 25. When this pulse CH is "1", the "1" input is selected whereas when this pulse CH is "0", the "0" input is selected. The shift register 26 is shift-controlled by the master clock pulse $\phi_M$.

The P number memory 23 receives the key codes KC of the respective channels produced by the key assigner 12 (FIG. 1) at the low speed time division timing as shown in FIG. 2(*e*) and provides the P number corresponding to the note name of the received key code KC. The read out P number is a signal of the same low speed time division timing as the signal shown in FIG. 2(*e*). The low-high speed conversion section 24 converts the time division timing of the read out P number to the high speed one. More specifically, the P number which was read out from the memory 23 at the low speed timing of the channel 1 is selected by the selector 25 when the channel synchronizing pulse CH has been turned to "1" at the timing of the high speed channel 1 and this selected P number is loaded in the shift register 26. Similarly, the P numbers which were read out from the memory 23 at the low speed timing of the channels 2, 3 and 4 are selected by the selector 25 when the channel synchronizing pulse CH has been turned to "1" at the timing of the corresponding high speed channels 2, 3 and 4 and loaded in the shift register 26. The P numbers loaded in the shift register 26 are circulatingly held therein through the "0" input of the selector 25 until the time when the pulse CH is turned to "1" at the high speed timing of that channel. Therefore, P numbers corresponding to the note names of the keys assigned to the channels 1–4 are loaded in the four stages of the shift register 26. These P numbers are shifted in response to the master clock pulse $\phi_M$ and delivered out repeatedly at a period which is four times as long as the master clock pulse $\phi_M$ (i.e., at the period of the common sampling frequency fc). Accordingly, the timing of the P numbers of the respective channels provided by the shift register 26 is as shown in FIG. 2(*b*). These P numbers consist, for example, of binary coded signals of twelve bits.

In FIG. 3, the note clock generation circuit 15 comprises an adder 27 which receives the P number provided by the shift register 26, a selector 28 which has received the output of this adder 27 at its "0" input, a shift register 29 of four stages which has received the output of this selector 28, a gate 30 which gates out less significant six bits (i.e., decimal section) of the output of the shift register 29 and an adder 31 which receives more significant seven bits (i.e., integer section) of the output of the shift register 29 and adds these seven bit data to an all "1" signal consisting of seven bits which are all "1". While the P number itself is a binary coded signal of twelve bits, the output of the adder 27 is a signal of thirteen bits including one additional bit as a bit alloted for a carry signal.

The inverted key-on pulse $\overline{\text{KONP}}$ (the timing relation thereof is shown in FIG. 2(*f*)) and a signal delivered out of a carry output CO of the adder 31 are applied to an AND gate 32 and the output of this AND gate 32 in turn is applied to a selection control input of the selector 28. When the output signal of the AND gate 32 is "0", the signal applied from the adder 27 to the "0" input of the selector 28 is selected whereas when the output signal of the AND gate 32 is "1", the signal applied to the "1" input of the selector 28 is selected. To the "1" input of the selector 28 is applied a signal consisting of less significant six bits (i.e., decimal section) of the output of the shift register 29 and the seven bits (i.e., integer section) of the adder 31.

The selector 28, shift register 29 and adder 31 constitute a circuit for establishing the frequency dividing number as shown in the above described equation (3) in accordance with the P number and effecting frequency-dividing of the common sampling frequency fc in response to the integer section of this frequency dividing number. The adder 27 is provided for adjusting the value of the integer section in accordance with the decimal section of the frequency dividing number.

Since the divisor 64 in the equation (3) is $2^6$, no particular division is required for obtaining the frequency dividing number but the frequency dividing number corresponding to the particular P number can be established simply by treating the less significant six bits of the P number as the decimal section. Accordingly, the less significant six bits in the output signal of thirteen bits from the adder 27, selector 38 and shift register 29 have weight of the decimal section and the more significant seven bits have weight of the integer section.

The addition of the all "1" signal in the adder 31 is equivalent to subtraction of 1. In the adder 31, therefore, subtraction of 1 from the integer value of the output of the shift register 29 is virtually made. The subtraction result of this adder 31 is fed back to the "1" input of the selector 28 together with the six bit data of the decimal section which were not subjected to the computation and applied to the adder 31 again through the shift register 29. Since the shift register 29 is shift-controlled by the master clock pulse $\phi_M$, the period at which a signal of the same channel is produced from the shift register 29 is four times as long as the master clock pulse $\phi_M$, i.e., the period of the common sampling frequency fc.

At the beginning of depression of a key, the inverted key-on pulse $\overline{\text{KONP}}$ is turned to "0" only once at a channel timing at which the depressed key has been assigned and, at this time, the P number of the key is selected through the "0" input of the selector 28. The integer section of this P number is applied from the shift register 29 to the adder 31 where 1 is repeatedly subtracted from the integer section at the period of the common sampling frequency fc. When the result of the subtraction as to the integer section is 1 or more, a carryout signal "1" is always produced from the carry output CO of the adder 31 and the AND gate 32 is thereby enabled so that the selector 28 continues selection at the "1" input. Upon turning of the output of the adder 31 to "0" as a result of repeated subtraction, i.e., when the frequency fc of the same number as the number of integer sections of the P number has elapsed, the carry out signal of the adder 31 is no longer produced so that the AND gate 32 is disabled. The selector 28 at this time selects the "0" input, selecting the output of the adder 27 which is a sum of the P number and the less significant six bits (decimal section data) of the output of the shift register 29. In the foregoing manner, the P number which has been somewhat modified in its value by the addition of the decimal section is supplied to the shift register 29 and subtraction of 1 from the integer value of the modified P number is repeated. The gate 30 is disabled by the inverted key-on pulse $\overline{\text{KONP}}$ only at the beginning of depression of the key and always supplies the decimal section data at other times. By the addition of the decimal section data to the P number in the adder 27, the integer value of the frequency dividing number actually used for frequency-dividing sometimes becomes larger than the integer value of the frequency dividing number obtained from the P number by 1. Taking, for example, the note name A, whose P number is 1785 and whose frequency dividing number is 27.89, frequency-dividing is initially effected in accordance with its integer value 27 but nextly the frequency dividing number becomes 27.89+0.89=28.78 and therefore frequency-dividing is effected in accordance with the integer value 28. Thus, the frequency-dividing of the common sampling frequency fc is performed in accordance with the number which is either the same as the integer value of the frequency dividing number obtained from the P number or larger than that by 1 and the frequency-dividing operation according to a frequency dividing number obtained from the P number in the form of an averaged result. The signal from the carry out output CO of the adder 31 is equivalent to its frequency-divided output and a signal obtained by inverting this signal is provided as the note clock pulse, i.e., the address change request signal CRQ.

For better understanding of the invention, an example of the output of the selector 28 is shown taking the note name A by way of example. The timing of change is the period of the common sampling frequency fc. Initially, the output of the selector 28 is frequency dividing number 27.89 corresponding to the P number 1785. Then, the output becomes 26.89 in which the integer value has decreased by 1 and the integer value of the output decreases successively by 1 to 25.89, 24.89, 23.89, . . . 2.89, 1.89. At the 27th period of the common sampling frequency fc, the numerical value applied to the "1" input of the selector 28 becomes 0.89 and, at this time, the carry out signal is turned to "0", the note clock pulse, i.e., the address change request signal CRQ is turned to "1" and the selector 28 selects the "0" input. To the "0" input of the selector 28 is applied the value 28.78 which is the sum of the frequency dividing number 27.89 corresponding to the P number 1785 and the decimal value 0.89 supplied from the shift register 29. Accordingly, 28.78 is provided from the selector 28. At this time, the output of the selector 28 decreases successively by 1 to 27.78, 26.78, 25,78, 24.78, . . . 2.78, 1.78 until the 28th period of the common sampling frequency fc at which the numerical value applied to the "1" input of the selector 28 becomes 0.78 and the carry out signal of the adder 31 is turned to "0" whereby the note clock pulse, i.e., the address change request signal CRQ is generated. At this time, the output of the adder 27 is 27.89+0.78=28.67 and this value is supplied to the shift register 29 through the "0" input of the selector 28. Thereafter, the output of the selector 28 decreases successively by 1 to 27.67, 26.67, 25.67, 24.67, . . . 2.67, 1.67. In the foregoing manner, the frequency-dividing is performed using 27 or 28 as the frequency dividing number.

Description of a Specific Example of the Octave Rate Data Generation Circuit 14

Figure 4:
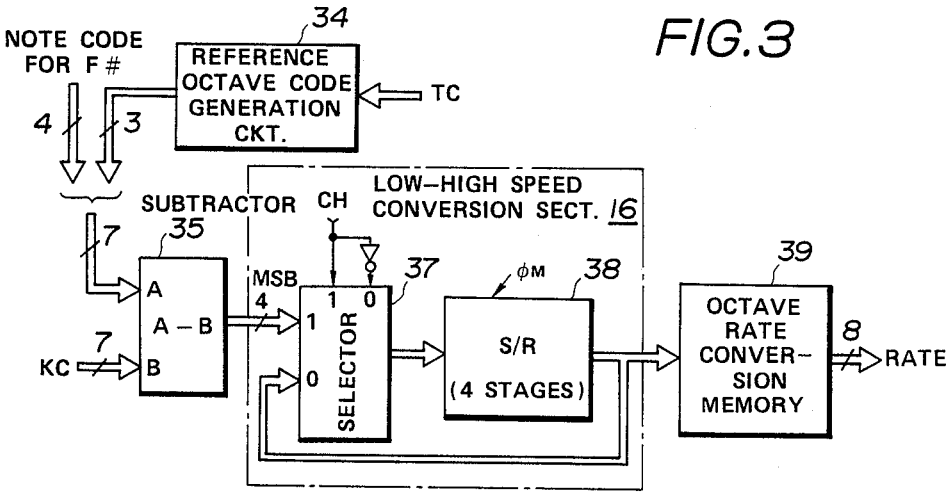
FIG. 4 is a block diagram showing a specific example of an octave rate data generation circuit in FIG. 1.

In FIG. 4, a reference octave code generation circuit 34 generates an octave code of three bits representing a predetermined reference octave in response to the tone color selection information TC. This octave code and a four-bit note code for F# representing the border of octaves are applied to an A input of a subtractor 35. To a B input of the subtractor 35 is applied the key code KC from the key assigner 12 (FIG. 1). The subtractor 35 performs subtraction A−B to obtain difference between the reference octave and the octave of the tone to be generated. Since this octave difference can be distinguished by more significant four bits in a seven-bit output which is difference between seven-bit key codes each consisting of the three-bit octave code and the four-bit note code, a result of subtraction as to the more significant four bits is produced by the subtractor 35. While the border of octaves in coding of octaves is conventionally placed between B note and C note, the border of octaves in setting the reference octave in this example is placed between F note and G note as shown in Table 1. For this reason, the subractor 35 performs subtraction using all bits of the key code. If, in setting of the reference octave, the border of octaves is placed between B note and C note as in the case of coding of the octave code, the subtractor 35 may perform subtraction between the octave codes only. The reference octave code generation circuit 34 realizes octave shift of a key in accordance with the selected tone color. For example, a typical reference octave is one ranging from G4 to F#5 as shown in Table 1.

A low-high speed conversion section 36 consists of a selector 37 and a shift register 38 constructed in the same manner as the conversion section 24. The octave difference data produced by the subtractor 35 is converted by this conversion section 36 to data of the high speed time division timing and thereafter is applied to an octave rate conversion memory 39. This octave rate conversion memory 39 outputs the octave rate data RATE as shown in the following Table 2 in response to the octave difference data applied thereto.

TABLE 2

| | output octave rate data RATE | | | | | | | |
|---|---|---|---|---|---|---|---|---|
| | (MSB) | | | | | | | (LSB) |
| input | integer section | | | | decimal section | | | |
| −3 | 1 | 0 | 0 | 0 | 0 | 0 | 0 | 0 |
| −2 | 0 | 1 | 0 | 0 | 0 | 0 | 0 | 0 |
| −1 | 0 | 0 | 1 | 0 | 0 | 0 | 0 | 0 |
| 0 | 0 | 0 | 0 | 1 | 0 | 0 | 0 | 0 |
| 1 | 0 | 0 | 0 | 0 | 1 | 0 | 0 | 0 |
| 2 | 0 | 0 | 0 | 0 | 0 | 1 | 0 | 0 |
| 3 | 0 | 0 | 0 | 0 | 0 | 0 | 1 | 0 |
| 4 | 0 | 0 | 0 | 0 | 0 | 0 | 0 | 1 |

The octave rate data RATE consists of eight bits with its more significant four bits being treated as the integer section and its less significant four bits as the decimal section. The decimal section functions as the interpolation information and represents the number of interpolation steps. The integer section functions as a signal demanding that a tone waveshape sample point amplitude signal be generated skipping several sample points of a tone waveshape amplitude in the tone generator 17 (FIG. 1). The greater a negative value of the input octave difference data, the higher is the octave than the reference octave whereas the greater a positive value of the input octave difference data, the lower is the octave than the reference octave. At the reference octave, the octave difference data is "0" and the octave rate data RATE is "1" in the decimal system which means that no skipping of the sample points or interpolation is performed. At one octave above the reference octave, the octave difference data is "−1" and the octave rate data RATE is "2" in the decimal system which means that one sample point is skipped over and the frequency of the generated tone is doubled. At two octaves above, the octave rate data RATE is "4" which means that three sample points are skipped over and the frequency of the generated tone is multiplied by 4. At three octaves above, the data RATE is "8" which means that seven sample points are skipped over and the frequency of the generated tone is multiplied by 8.

At one octave below the reference octave, the octave difference data is "1" and the data RATE is "0.5" in the decimal system. This means that an amplitude signal at the same sample point is generated twice successively in the tone generator 17 (FIG. 1) in accordance with a sampling period corresponding to the timing of generation of the address change request signal CRQ and the frequency of the generated tone thereby is reduced to one half. This also indicates that interpolation be made with an interpolation step number 2. At two octaves below, the data RATE is "0.25" in the decimal system which indicates that an amplitude signal at the same sample point be generated four times successively thereby reducing the frequency to a quarter and interpolation be made with an interpolation step number 4. Similarly, as the octave becomes lower, the number of times the amplitude signal is generated at the same sample point increases and the interpolation step number also increases.

Description of a Specific Example of the Address Signal Generation Circuit 16

Figure 5:
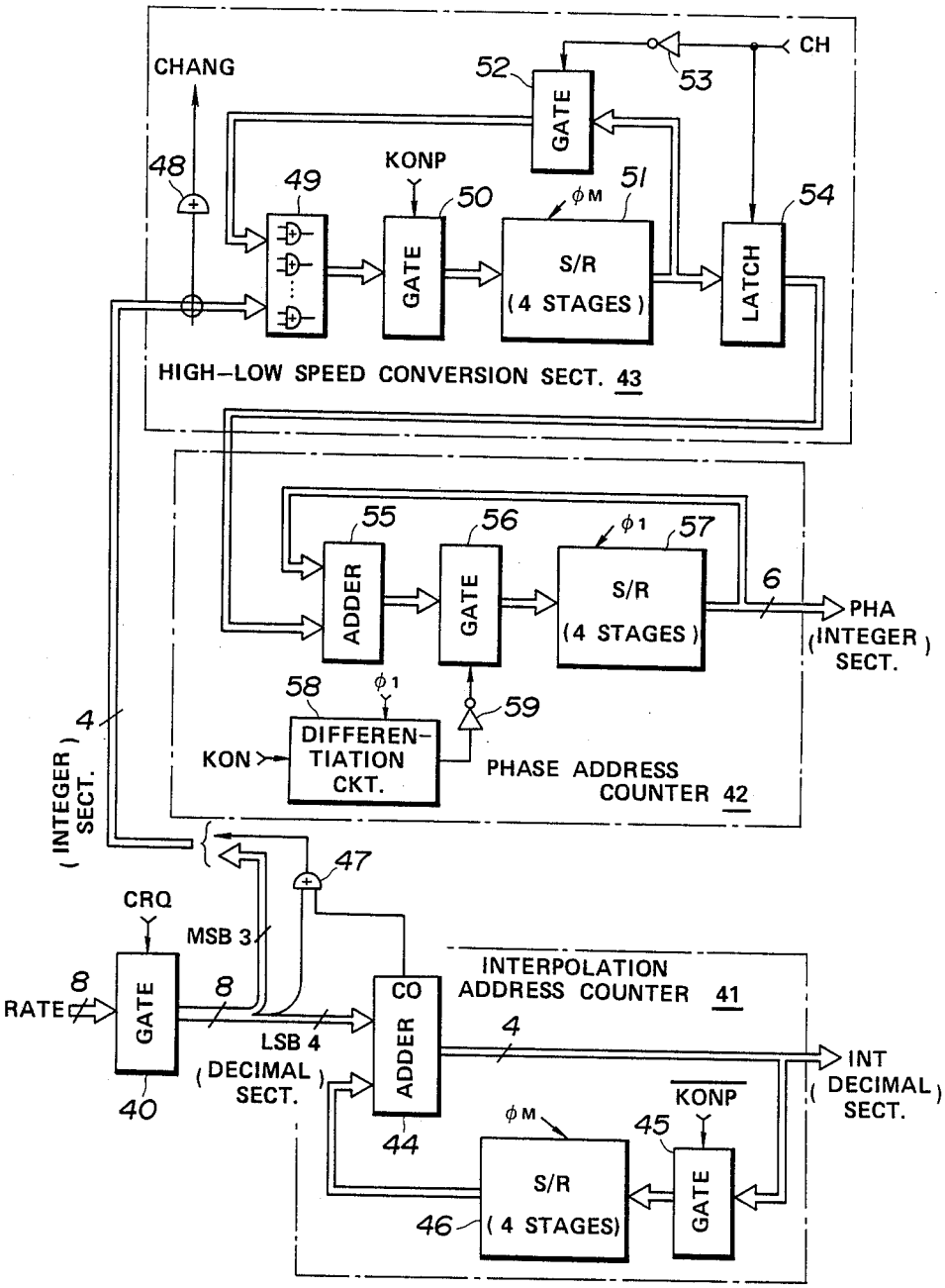
FIG. 5 is a block diagram showing a specific example of an address signal generation circuit in FIG.

In FIG. 5, the octave rate data RATE generated by the octave rate data generation circuit 14 (FIG. 4) is applied to a gate 40. To a control input of this gate 40 is also applied the note clock pulse, i.e., the address change request signal CRQ generated by the note clock generation circuit 15 (FIG. 3). In this gate 40, the octave rate data RATE is selected at each timing of generation of the note clock pulse, i.e., the address change request signal CRQ and added together for generation of the phase address signal PHA and the interpolation address data INT as will be discussed more fully later.

The address signal generation circuit 16 comprises an interpolation address counter 41 for generating the interpolation address data INT, a phase address counter 42 for generating the phase address signal PHA and a high-low speed conversion section 43 for converting data of the integer section of the rate data RATE to be counted by the phase address counter 42 to data of the low speed time division timing.

Less significant four bits (decimal section) of the octave rate data RATE which has been gated out of the gate 40 are applied to an adder 44 in the interpolation address counter 41. The output of the adder 44 is applied to a shift register 46 via a gate 45 which is controlled by the inverted key-on pulse $\overline{\text{KONP}}$. The shift register 46 has four stages corresponding to the number of channels and is controlled by the master clock pulse $\phi_M$. The output of the shift register 46 is applied to another input of the adder 44. By virtue of this construction, the decimal section (i.e., the interpolation information) of the octave rate data RATE for a certain channel is added and counted each time the address change request signal CRQ is generated and a result of this addition is circulatingly held in the shift register 46 in correspondence to the timing of that channel. The output of the adder 44 is provided as the interpolation address data INT. The adder 44 is a full-adder of four bits and a carry out signal produced from its carry out output CO is applied to an OR gate 47. The gate 45 is disabled at the beginning of depression of the key thereby clearing data stored in the shift register 46 but is enabled at other times.

More significant four bits (integer section) of the octave rate data RATE which has been gated out of the gate 40 are applied to the high-low speed conversion section 43. Among these four bits, the least significant bit (i.e., the bit having weight of the integer "1") is applied to the conversion section 43 via an OR gate 47. The OR gate 47 is provided for carrying the carry out signal of the adder 44 to the least significant bit of the integer section of the octave rate data RATE, i.e., the bit having the weight of integer "1".

The signal of all bits of the integer section of the octave rate data RATE including the output of the OR gate 47 is applied to the OR gate 48. When any of the four-bit signals which have been applied to the OR gate 48 is "1", the output of the OR gate 48 is turned to "1" and this output is provided as a pitch synchronization change pulse CHANG. This pulse CHANG is synchronized with the timing of generation of the address change request signal, i.e., the note clock pulse (synchronized with the pitch of the tone to be generated), and indicates that the phase address signal PHA should be changed.

In the high-low speed conversion section 43, OR gate group 49 gates out the integer section of the octave rate data RATE which has been applied thereto via the gate 40 and the OR gate 47 and supplies this integer section to a gate 50. The gate 50 is controlled by the inverted key-on pulse $\overline{\text{KONP}}$ and is disabled only at the beginning of depression of the key and is enabled at other time. The output of the gate 50 is applied to a four-stage shift register 51 in which it is shifted by the master clock pulse $\phi_M$. The output of the shift register 51 is fed back to its input via a gate 52, OR gate group 49 and gate 50. The gate 52 is enabled by a signal obtained by inverting the channel synchronizing pulse CH by an inverter 53. In the meanwhile, the output of the shift register 51 is applied to a latch circuit 54 and loaded in this latch circuit 54 at a timing of the channel synchronizing pulse CH.

This arrangement enables the four-bit data of the integer section of the octave rate data RATE for each channel to be temporarily stored in the shift register 51 and to be circulated in accordance with the high speed time division timing. By the channel synchronizing pulse CH which is generated in the manner shown in FIG. 2(*c*), outputs of the respective channels of the shift register 51 are latched in the latch circuit 54 channel by channel substantially at a period equivalent to the low speed time division timing. When the output of the shift register 51 has been latched in the latch circuit 54, the gate 52 is closed to prevent circulation of the data and clear the storage of the data. Data of a certain channel which has been latched in the latch circuit 54 is also cleared when a next channel synchronizing pulse CH has been generated. Accordingly, data of the integer section of the octave rate data RATE of a certain channel loaded at a timing of generation of the address change request signal CRQ is held in the latch circuit 54 only during 13 or 17 periods of the master clock pulse $\phi_M$ from generation of the channel synchronizing pulse CH at the high speed time division timing of the channel till generation of a next pulse CH.

The phase address counter 42 comprises an adder 55 which receives the output of the latch circuit 54, a gate 56 and a four-stage shift register 57 which is shift-controlled by a low-speed clock pulse $\phi_1$. The output of the shift register 57 is supplied to the adder 55 and fed back to the input side via the gate 56. The gate 56 is disabled at the beginning of depression of the key by the output of an inverter 59 which inverts the output of a differentiation circuit 58 differentiating a rise portion of the key-on signal KON supplied by the key assigner 12

(FIG. 1) in accordance with the low speed time division timing and thereby clears old data for the channel to which the key has been assigned stored in the shift register 57. The output of the latch circuit 54 is applied to the adder 55 in which it is added to the output of the shift register 57 and a result of the addition is stored in the shift register 57. This addition is performed at a period which is four times as long as the low-speed clock pulse for one channel. Since, on the other hand, time width at which data for a certain channel is provided from the latch circuit 54 is 13 or 17 period of the master clock pulse $\phi_M$, the output of the latch circuit 54 is added only once to the output of the shift register 57 for the same channel. The shift register 57 performs loading and shifting of data in synchronism with falling (i.e., change from "1" to "0") of the low-speed clock pulse $\phi_M$. Thus, in the phase address counter 42, the integer section (including a carry portion from the decimal section) of the octave rate data RATE corresponding to a certain channel is added and counted only once each time the note clock pulse, i.e., the address change request signal CRQ, is generated once in correspondence to that channel. The output of the address counter 42 is supplied to the tone generator 17 (FIG. 1) as the phase address signal PHA. This phase address signal PHA consists, for example, of a six-bit binary coded signal and is capable of having 64 different sample points in a waveshape of one period. This applies, however, to a case where the tone generator 17 generates the same waveshape of one period repeatedly. In a case where plural periods of different waveshapes are generated, the bit number of the phase address signal PHA is increased.

Since, in FIG. 5, the integer section of the octave rate data RATE is counted in accordance with the low speed time division timing whereas the decimal section is counted in accordance with the high speed time division timing, the phase address counter 42 for counting the integer section and the interpolation address counter 41 for counting the decimal section are provided separately from each other. If, however, the time division speed is not taken into account, an arrangement may be made so that the eight-bit octave rate data RATE is counted by a single address counting device. In that case, the integer section of an address signal obtained is used as the phase address signal PHA and the decimal section as the interpolation address data INT respectively.

Description of the Tone Generator 17

The phase address counter 42 produces the phase address signals PHA for the respective channels in a time division multiplexed state at the low speed timing in accordance with the low-speed clock pulse $\phi_M$. The tone generator 17 generates tone waveshape amplitude signals at sample points which are specified by the phase address signals PHA. Any suitable tone generation system may be employed in the tone geneator 17. Such systems include, for example, one in which tone waveshape amplitude values for respective sample points are stored in a waveshape memory and these amplitude values are read out by the address signal PHA, a harmonics synthesis system, a frequency modulation operation system and one in which a tone waveshape signal is generated by timewise interpolating segment waveshapes and switching these waveshapes as disclosed in the specification of Japanese Preliminary Patent Publication No. 147793/1985. In reading out waveshape data from a waveshape memory, a waveshape stored in the memory is not necessarily a waveshape for one period but it may be a half period of waveshape or a waveshape of plural periods or a full waveshape from the start of sounding of a tone to the end thereof. Since the phase address signal PHA is a signal of the low speed time division timing, a relatively long operation time can be provided for generation of a tone waveshape amplitude signal for one sample point in the tone generator 17 whereby computation for generating a complex tone waveshape can be realized.

Description of a Specific Example of the Pitch Synchronization and Interpolation Circuit 18

Figure 6:
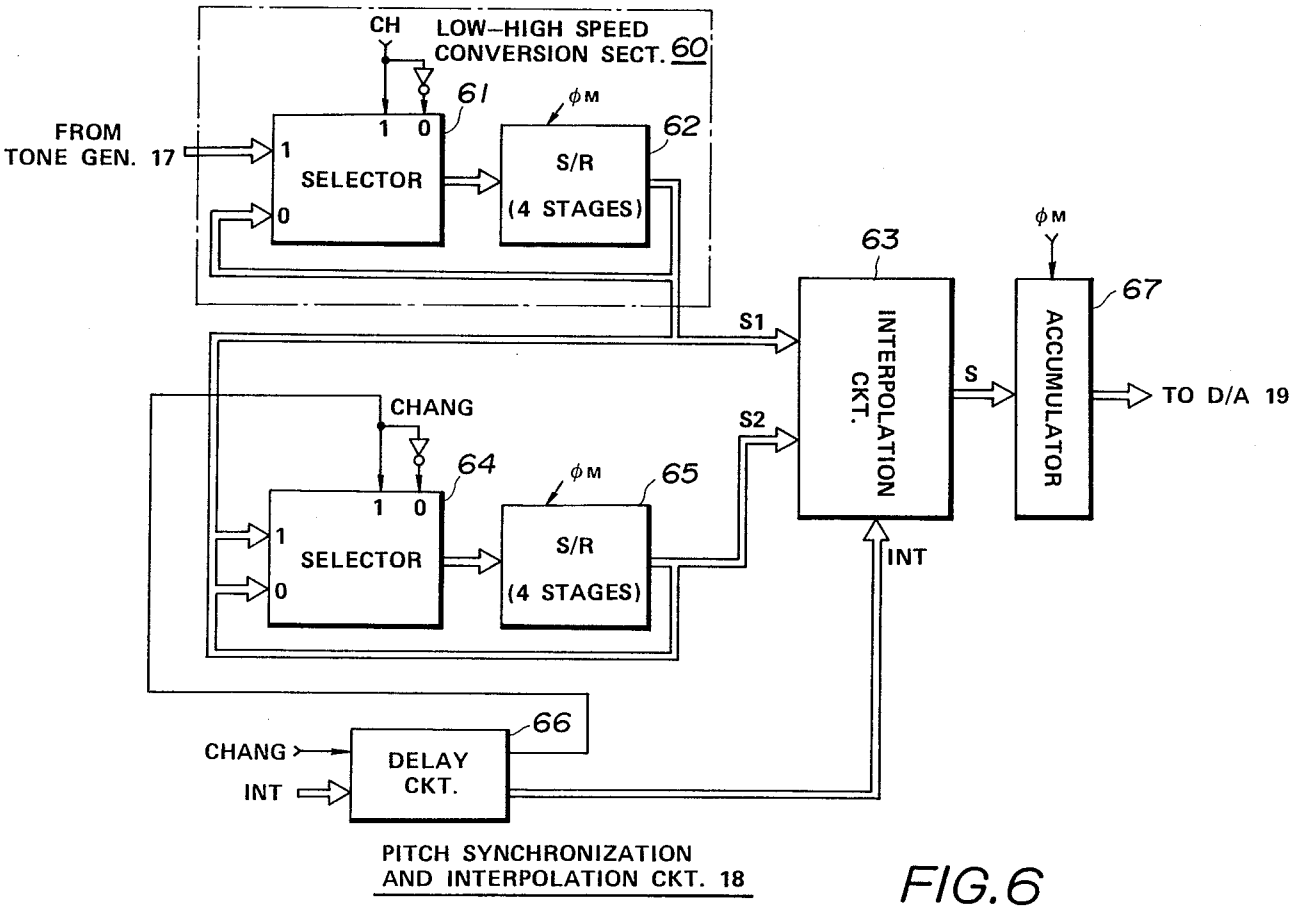
FIG. 6 is a block diagram showing a specific example of a pitch synchronization and interpolation circuit.

Referring to FIG. 6, the tone waveshape sample point amplitude signals for the respective channels generated at the low speed time division timing by the tone generator 17 are applied to a low-high speed conversion section 60 and converted to signals of the high speed time division timing. The low-high speed conversion section 60 consists, as the conversion section 24 shown in FIG. 3, a selector 61 and a four-stage shift register 62.

The tone waveshape sample point amplitude signals which have been converted to the signals of the high speed time division timing are supplied to an interpolation circuit 63 as signals S1 for present sample points and also stored in a shift register 65 through a selector 64. The shift register 65 consists of four stages and shift-controlled by the master clock pulse $\phi_M$. The output of the shift register 65 is held circulatingly through a "0" input of the selector 64 and also is applied to the interpolation circuit 63 as amplitude signals S2 for preceding sample points. The pitch synchronization change pulse CHANG generated by the address signal generation circuit 16 (FIG. 5) and the interpolation address data INT are supplied to a delay circuit 66 in which these signals are delayed by a period of time corresponding to delay time between input and output signals in the tone generator 17. This delay circuit 66 can be omitted if there is no time delay between the input and output signals in the tone generator 17. The delayed pitch synchronization change pulse CHANG is applied to a selection control input of the selector 64 and the delayed interpolation address data INT is applied to the interpolation circuit 63. When the pitch synchronization change pulse CHANG is "1", the selector 64 selects a sample point amplitude signal which has been applied to the "1" input from the low-high speed conversion section 60 and supplies this selected signal to the shift register 65. When the pitch synchronization change pulse CHANG is "0", the selector 64 selects the "0" input whereby data stored in the shift register 65 is circulatingly held.

As described previously, the pitch synchronization change pulse CHANG is generated in synchronism with the pitch of the phase address signal PHA (i.e., in synchronizm with the timing of generation of the note clock pulse) when the phase address signal PHA should be changed. Due to the conversion processing in the high-low conversion section 43 (FIG. 5), the phase address signal PHA does not change in synchronism with the pitch of the tone to be generated. Accordingly, the tone waveshape sample point amplitude signal generated by the tone generator 17 in response to this phase address signal PHA does not change either in synchronism with the pitch of the tone to be generated so that a noise which is not harmonic with the pitch of the tone will be produced. For avoiding such inconvenience, the selection control is performed in the selector 64 in accordance with the pitch synchronization change pulse CHANG for resampling, in synchronism with the pitch of the tone to be generated, the tone waveshape sample point amplitude signal generated by the tone generator 17. By this arrangement, the sample point amplitude signal for each channel stored in the shift register 65 is converted to a signal which changes in synchronism with the pitch of the tone to be generated in that channel with a result that the amplitude signal S2 for the preceding sample point applied to the interpolation circuit 63 changes in synchronism with the pitch of the tone to be generated.

After generation of the pitch synchronization change pulse CHANG, the value of the phase address signal PHA changes and, in response thereto, the tone waveshape sample point amplitude signal generated by the tone generator 17 changes. Thus, when the tone waveshape sample point amplitude signal produced by the low-high speed conversion section 60 exhibits the amplitude value of the present sample point, the signal of the same channel produced by the shift register 65 exhibits the amplitude value of the immediately preceding sample point.

The interpolation circuit 63 interpolates a section between the applied present sample point amplitude signal S1 and the applied preceding sample point amplitude signal S2 in accordance with the interpolation address data INT. When the interpolation address data INT is "0", the preceding sample point amplitude signal S2 supplied from the shift register 65 is directly delivered out. If the tone range to which the tone to be generated belongs is higher than the reference octave, the interpolation address data INT is always "0" so that no interpolation is performed but the preceding sample point amplitude signal S2 which has been brought into the pitch synchronized state through the selector 64 and the shift register 65 provided for the pitch synchronization is always delivered out of the interpolation circuit 63 (in this case, this signal S2 virtually constitutes the present sample point amplitude signal because the present sample point amplitude signal S1 is not used at all).

If the tone range to which the tone to be generated is lower than the reference octave, the interpolation address data INT changes at a rate corresponding to the value of the decimal section of the octave rate data RATE and the interpolation is effected. Since the interpolation address data INT is a binary coded signal, the interpolation step number is sixteen steps at the maximum but the actual interpolation step number is determined by the value of the decimal section of the octave rate data RATE. For example, in a tone range one octave below the reference octave, the value of the decimal section of the data RATE is "1000" as shown in Table 2 and the interpolation address data INT generated by the interpolation address counter 41. (FIG. 5) is "0000" and "1000" alternately and repeatedly so that a section between two adjacent sample points is interpolated in two steps. In a tone range two octaves below the reference octave, the value of the data RATE is "0100" and the interpolation address data INT repeats "0000", "0100", "1000" and "1100" so that a section between two adjacent sample points is interpolated in four steps. Similarly, as the octave becomes lower, the value of the decimal section of the data RATE becomes smaller and the interpolation step number increases. When the interpolation address data INT successively changes to "0000", a carry out signal is produced by the adder 44 in FIG. 5. This causes the pitch synchronization change pulse CHANG to be generated and the present sample point amplitude signal S1 to be loaded in the shift register 65 through the shift register 64 as the preceding sample point amplitude signal S2. On the other hand, the phase address signal PHA is advanced by one address due to generation of the pulse CHANG whereby the sample point of the tone waveshape sample point amplitude signal generated by the tone generator 17 is switched to a next one.

Since the interpolation address data INT changes in accordance with the timing of generation of the note clock pulse, i.e., the address change request signal CRQ, the interpolation is effected at a timing synchronized with the pitch of the tone to be generated. This prevents an interpolation clock component from becoming a noise and instead enables it to be harmonized with the pitch of the tone to be generated.

The tone waveshape amplitude signals S1 and S2 of the two adjacent sample points applied to the interpolation circuit 63 which are subjected to the interpolation are also signals which change in synchronism with the pitch of the tone to be generated. As to the amplitude signal S2 of the preceding sample point, this signal S2 is loaded in the shift register 65 in accordance with the pitch synchronization change pulse CHANG as previously described so that it becomes a signal which changes in synchronism with the pitch. As to the amplitude signal S1 of the present sample point, no particular pitch synchronization operation is effected. This is because the same effect as the pitch synchronization operation is obtained without performing such operation. The pitch synchronization operation is performed in accordance with the pitch synchronization change pulse CHANG and this pitch synchronization operation must necessarily be performed for a tone waveshape sample point amplitude signal which has possibility of being substantially used at the generation of the pitch synchronization change pulse CHANG. As described above, the interpolation address data INT is "0" when the pitch synchronization change pulse CHANG is generated and the preceding sample point amplitude signal S2 is always selected directly whereas the present sample point amplitude signal S1 is not used. When the interpolation data INT has changed thereafter, the section between the two signals S1 and S2 is substantially interpolated. At this time, a tone waveshape amplitude signal at a sample point corresponding to the address signal PHA which has changed in response to the pitch synchronization change pulse CHANG has already been produced by the tone generator 17 and the present sample point amplitude signal S1 is provided by the low-high speed conversion section 60 without fail. Accordingly, interpolation can be effected without fail between the preceding sample point amplitude signal S2 and the present sample point amplitude signal S1. For this reason, the pitch synchronization operation as illustrated is necessary for the system of the preceding sample point amplitude signal S2 whereas the pitch synchronization can be achieved without a particular pitch synchronization operation with respect to the system of the present sample point amplitude signal S1. If desired, however, a pitch synchronization operation can be effected for the present sample point amplitude signal S1 by providing a pitch synchronization operation circuit constructed in the same manner as the circuitry including the selector 64 and the shift register 64, utilizing the output of this circuit as the present sample point amplitude signal S1 and applying this signal S1 to a "1" input of the selector 64.

In FIG. 6, the output of the interpolation circuit 63 is applied to an accumulator 67 in which tone waveshape sample point amplitude signals for four channels are accumulated and the time division multiplexed state of the respective channels is cancelled. The output of the accumulator 67 is a sum signal of the tone waveshape sample point amplitude signals for the four channels and has a sampling frequency which is four times as long as the master clock pulse $\phi_M$, i.e., the common sampling frequency fc.

Description of a Specific Example of the Interpolation Circuit 63

The interpolation circuit 63 performs interpolation in accordance with a predetermined interpolation function and may be constructed of any suitable circuit. As the interpolation function, a desired one among functions such as linear interpolation, secondary interpolation and trigonometric function interpolation may be employed. If an interpolation function other than the linear interpolation is used, suitable means for generating an interpolation coefficient in response to the interpolation address data INT is provided. In the case of the linear interpolation, the interpolation address data INT can be directly used as the interpolation coefficient.

Figure 7:
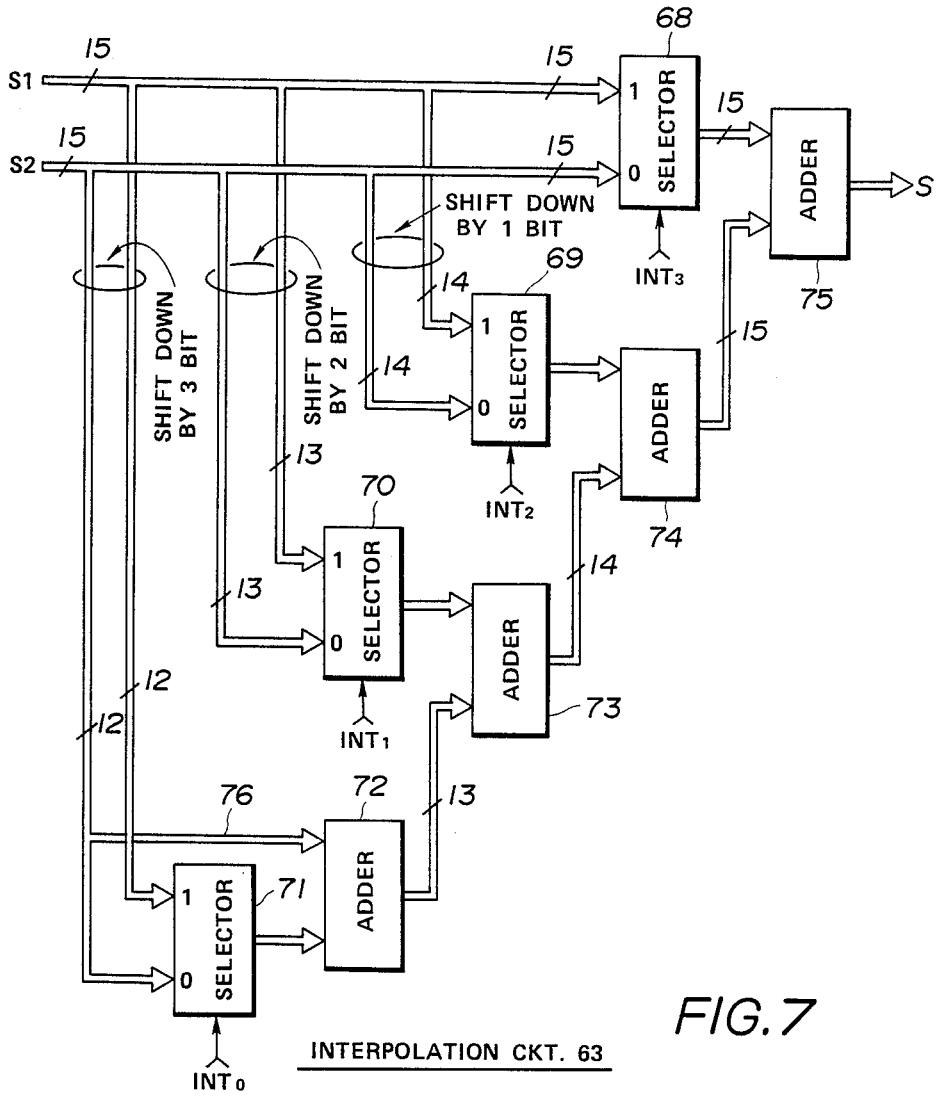
FIG. 7 is a block diagram showing a specific example of an interpolation circuit in FIG. 6.

FIG. 7 shows an example of the interpolation circuit 63 employing the linear interpolation. The present sample point amplitude signal S1 and the preceding sample point amplitude signal S2 are respectively digital signals of fifteen bits. All fifteen bits of the signal S1 are applied to a "1" input of a selector 68 and all fifteen bits of the signal S2 are applied to a "0" input of the selector 68. To "1" and "0" inputs of a selector 69 are respectively applied signals of fourteen bits obtained by shifting down the signals S1 and S2 by one bit. To "1" and "0" inputs of a selector 70 are respectively applied signals of thirteen bits obtained by shifting down the signals S1 and S2 by two bits. To "1" and "0" inputs of a selector 71 are respectively applied signals of twelve bits obtained by shifting down the signals S1 and S2 by three bits. To selection control inputs of the selectors 68–71 are respectively applied respective bits INT3–INT0 of the interpolation address data INT. The bit INT3 is the most significant bit, the bit INT2 is a bit of the second weight, the bit INT1 is a bit of the third weight and the bit INT0 is the least significant bit. The selectors 68–71 select the "1" input when the value of the corresponding bit of the interpolation address data INT (functioning as the interpolation coefficient) applied to the selection control input thereof is "1" and select the "0" input when the value of the corresponding bit is "0".

The output of the selector 71 and a signal on a line 76 which is obtained by shifting down the signal S2 by three bits are added together in an adder 72. The output of the adder 72 and the output of the selector 70 are added together in an adder 73. The output of the adder 73 and the output of the selector 69 are added together in an adder 74. The output of the adder 74 and the output of the selector 68 are added together in an adder 75. The output of the adder 75 is supplied to the accumulator 67 as the output signal S of the interpolation circuit 63.

By the interpolation circuit 63 of the above described construction, a linear interpolation operation as shown by the following equation can be implemented:

$$S = a \times S1 + b \times S2 \quad (5)$$

In this equation, a represents the interpolation address data INT, i.e., interpolation coefficient expressed in the decimal system. Since $a+b=1$, b is a decimal system number $b=1-a$ and if b is expressed as a complement, b becomes $b=\bar{a}+1$ (where 1 has weight corresponding to the least significant bit of a expressed in the binary system).

Accordingly, the equation (5) can be implemented by multiplying the present sample point amplitude signal S1 with the respective bits INT3–INT0 of the interpolation address data INT, multiplying the preceding sample point amplitude signal S2 with respective bits of an inverted signal of the data INT and also multiplying the signal S2 with "0001", and adding results of these multiplications together. Assuming that the weight of the most significant bit of the four-bit coefficient is 1, weight of the next bit INT2 is $\frac{1}{2}$, that of the bit INT1 is $\frac{1}{4}$ and that of the bit INT0 is $\frac{1}{8}$. Accordingly, multiplication of the respective bits INT3–INT0 with the signals S1 and S2 can be effected simply by shifting down the signals S1 and S2 which are multiplicands by one bit, two bits or three bits. For this purpose, the signals obtained by shifting down the signals S1 and S2 by predetermined bits are applied to the selectors 69–71. In a case where the bit of the interpolation coefficient which is a multiplier is "0", its product is "0" without performing particular multiplication so that no such multiplication is necessary. Accordingly, as to the signal S1 with which the coefficient a is to be multiplied, it will suffice if multiplication is made with a bit whose logical value is "1" among the bits INT3–INT0. Therefore, when a corresponding one of the bits INT3–INT0 is "1" in the selectors 68–71, the signal S1 or the signal obtained by shifting down the signal S1 by a predetermined number of bits is selected and the selected output is added through the adders 72–75 whereby the multiplication of the first term of the right member of the equation (5), i.e., $a \times S1$, can be implemented. As to the signal S2 with which the coefficient b is to be multiplied, it will suffice if it is multiplied with the inverted signal $\bar{a}$ of the coefficient a and also with "0001" so that a bit whose logical value is "0" among the bits INT3–INT0 is inverted and the signal S2 is multiplied with this inverted signal as well as with "0001". Therefore, when a corresponding one of the bits INT3–INT0 is "0" in the selectors 68–71, the signal S2 or the signal obtained by shifting down the signal S2 by a predetermined number of bits is selected, a signal obtained by shifting down the signal S2 by three bits (this signal is equivalent to a product of multiplication of the signal S2 with "0001") is applied to the adder 72 via the line 76, and these selected outputs and the signal on the line 76 are added in the adders 72–75 whereby the multiplication of the second term of the right member of the equation (5), i.e., $b \times S2$, can be implemented. Further, the adders 72–75 perform the function of adding the products of the first and second terms of the right member of the equation (5) together. In the foregoing manner, the adder 75 provides the signal S which is equivalent to a result of the interpolation operation of the equation (5).

In the example shown in the figure, less significant bits of the signals obtained by shifting down the signals S1 and S2 are discarded by the number of bits shifted down. Alternatively, all of the fifteen bits may be applied and these bits may be weighted in the input stages of the adders 72–75 in accordance with the number of bits to be shifted down.

Description of a Modified Example

Figure 8:
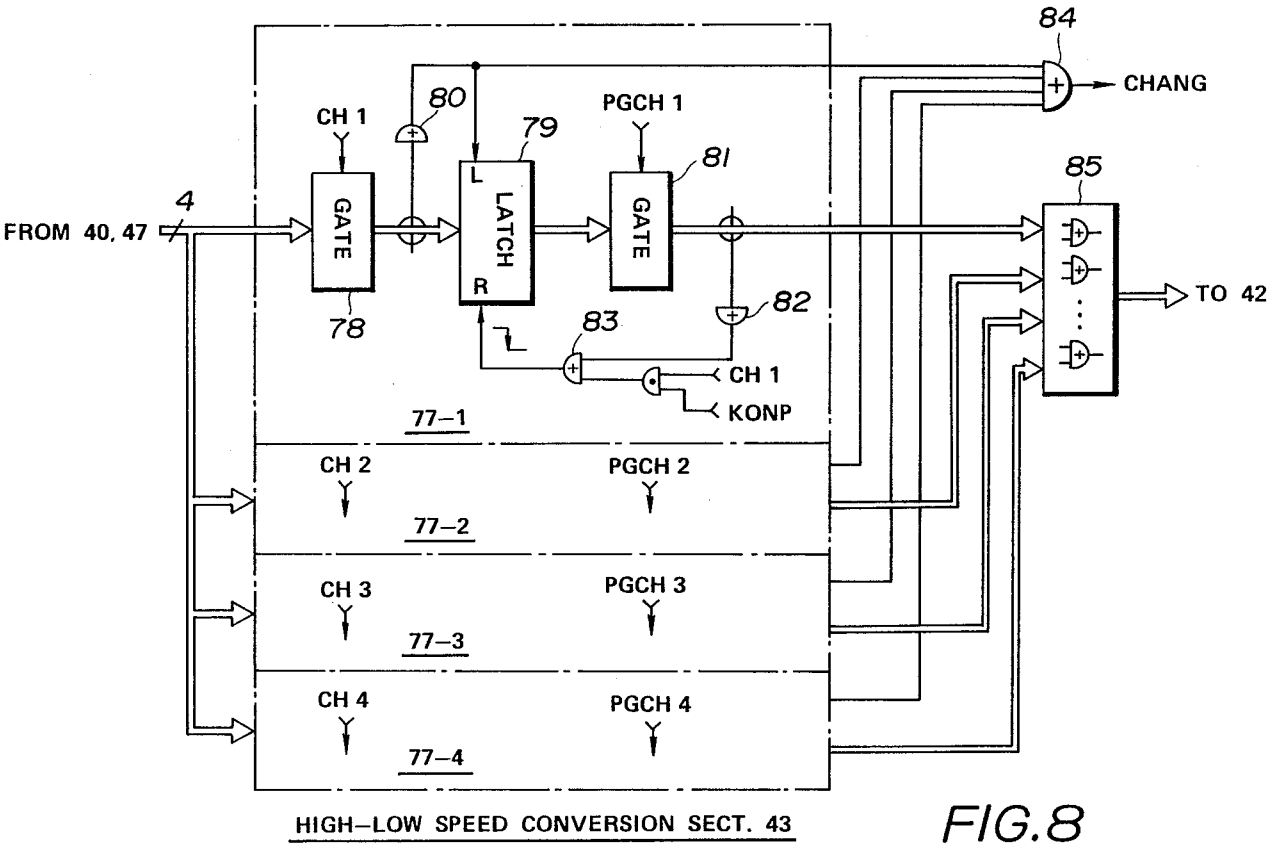
FIG. 8 is a block diagram showing a modified example of a high-low speed conversion section in FIG. 5.

In the address signal generation circuit 16 shown in FIG. 5, the high-low speed conversion section 43 may be modified as shown in FIG. 8.

In the example shown in FIG. 8, the high-low speed conversion of the time division speed is performed channel by channel in parallel. In the figure, a high-low speed conversion circuit 77-1 for the channel 1 only is illustrated in detail but other circuits 77-2 through 77-4 for the other channels are of the same construction except that high speed channel timing pulses CH1–CH4 and low speed channel timing pulses PGCH1–PGCH4 used in these circuits are different one channel from another. An example each of the timing pulses CH1–CH4 and PGCH1–PGCH4 is shown in FIGS. 2(*g*) and 2(*h*).

Integer section data of the octave rate data RATE derived from the gate 40 through the OR gate 47 in FIG. 5 is applied to a gate 78. This gate 78 is opened in response to the high speed channel timing pulse CH1 corresponding to the channel 1 and the integer section data for the channel 1 is applied to a latch circuit 79 through the gate 78. All bits of the output of the gate 78 are applied to an OR gate 80 and when any bit of the integer section which has been gated out of the gate 78 is "1", the output of the OR gate 80 is turned to "1". The output of this OR gate 80 is applied to a latch control input L of the latch circuit 79 and thereby causes the integer section data to be latched in the latch circuit 79. The output signal "1" of the OR gate 80 is also delivered out through an OR gate 84 as the pitch synchronization change pulse CHANG.

The integer section data latched in the latch circuit 79 is applied to a gate 81 and is gated out of the gate 81 in response to the low speed channel timing pulse PGCH1 corresponding to the channel 1. All bits of the output of the gate 81 are applied to an OR gate 82 and when any of the integer section data which is "1" is gated out of the gate 81, the output of the gate 82 is turned to "1". This output signal "1" of the OR gate 82 is applied to a reset input R of the latch circuit 79 through an OR gate 83. In the latch circuit 79, data latched therein is reset when the signal in the reset input R falls from "1" to "0". Accordingly, immediately upon elapse of time equivalent to the pulse width of the pulse PGCH1 (e.g., time of sixteen periods of the master clock pulse $\phi_M$) after the integer section data of the octave rate data RATE latched in the latch circuit 79 has been selected by the gate 81, the data latched in the latch circuit 79 is reset. To other inputs of the OR gate 83 is applied an ANDed ouptut of the inverted key-on pulse $\overline{\text{KONP}}$ and the high speed channel timing pulse CH1.

In the above described manner, the conversion circuit 77-1 for the channel 1 converts the integer section data of the octave rate data RATE for this channel to data of the low speed time division timing controlled by the low speed channel timing pulse PGCH1. The other circuits 77-2 through 77-4 likewise convert data for their channels to data of the low speed time division timing. The data of the low speed time division timing provided by the conversion circuits 77-1 through 77-4 are multiplexed by an OR gate group 85 and thereafter are supplied to the adder 50 (FIG. 5) of the phase address counter 42.

Description of Another Embodiment

Figure 9:
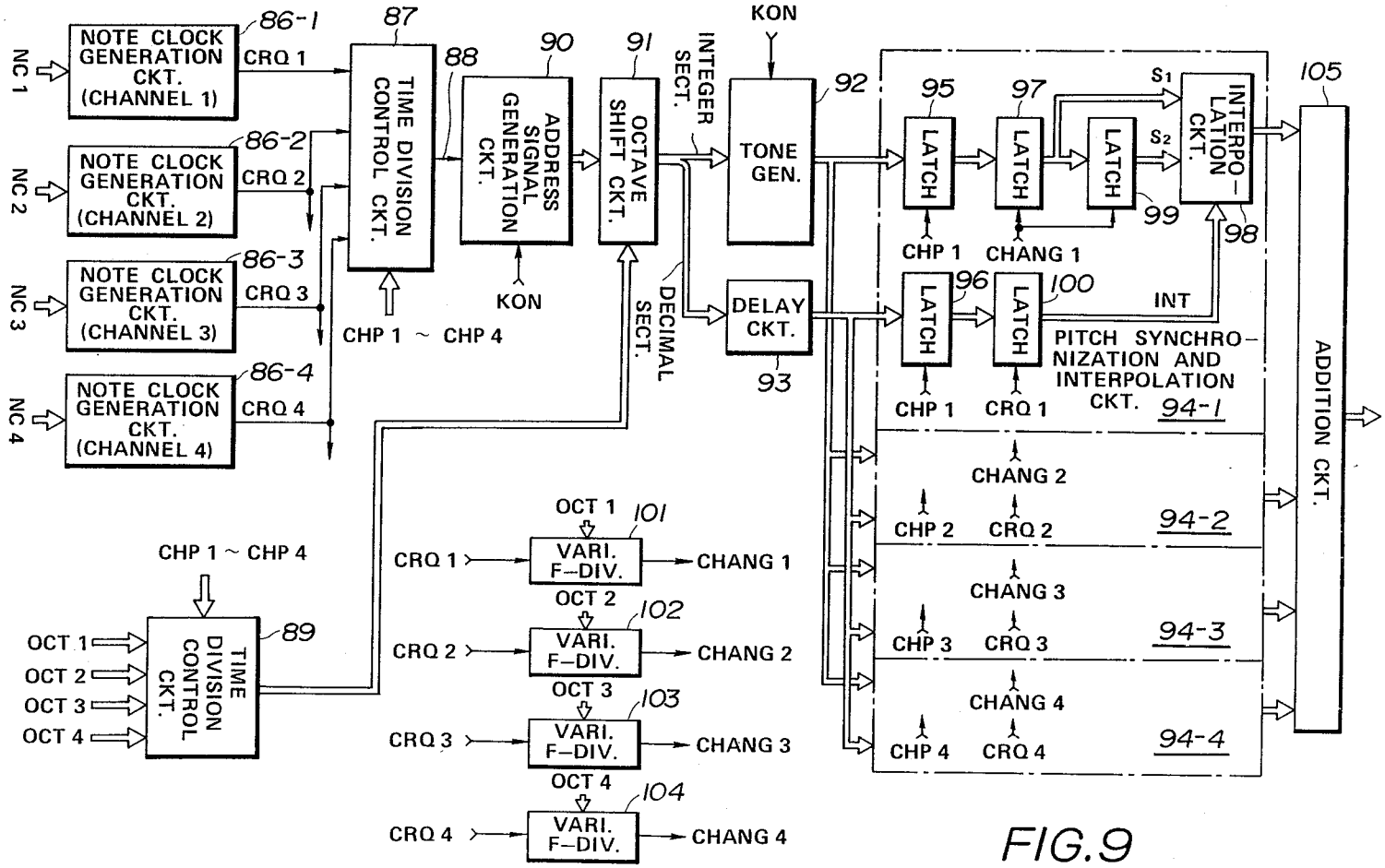
FIG. 9 is a block diagram showing another embodiment of the invention.
Figure 10:
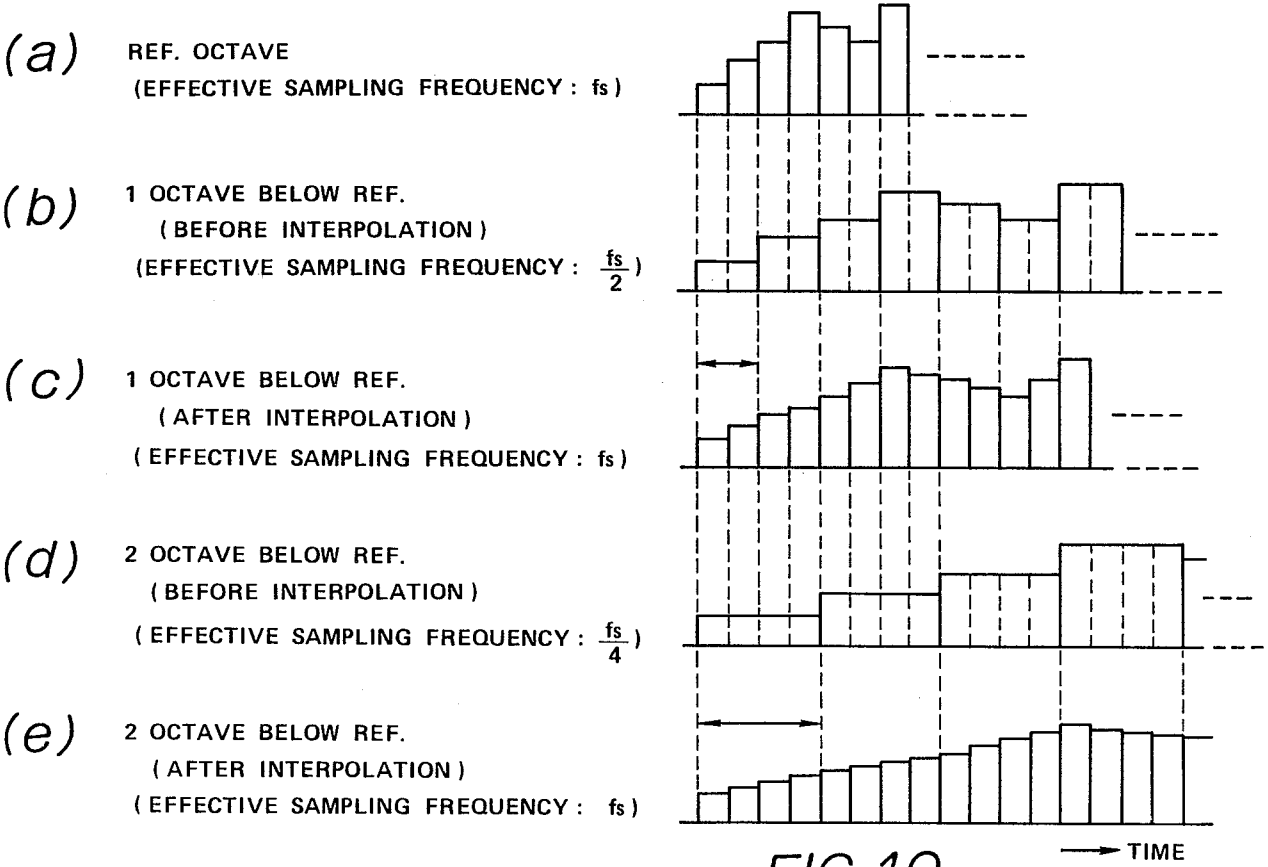
FIGS. 10(*a*)-(*e*) are waveshape diagrams of a tone waveshape sample point amplitude signal showing an example of interpolation between sample points in accordance with the octave performed according to the invention.

FIG. 9 shows another embodiment of the invention. In FIG. 9, illustration of the circuit portion including the keyboard, depressed key detection circuit and key assigner is omitted. NC1–NC4 represents note codes indicating note names of keys assigned to the respective channels 1–4 and these note codes NC1–NC4 are applied in parallel to note clock generation circuits 86-1 through 86-4. The note clock generation circuits 86-1 through 86-4 respectively generate note clock pulses, i.e., address change request signals CRQ1–CRQ4 which have frequencies corresponding to the note names of the applied note codes NC1–NC4. The circuits 86-1 through 86-4 may be of any known construction, e.g., a variable frequency-dividing circuit of a voltage-controlled type clock oscillator.

The note clock pulses, i.e., the address change request signals CRQ1–CRQ4, for the tones to be generated in the respective channels are applied to a time division control circuit 87 in which they are time division multiplexed in acordance with channel timing pulses CHP1–CHP4. A specific example of this time division contol circuit 87 is not shown. The pulses CHP1, CHP2, CHP3 and CHP4 are timing pulses which, as the pulses CH1–CH4 shown in FIG. 2(*g*), are generated in correspondence to time division time slots of the respective channels. Responsive to these pulses CHP1–CHP4, the note clock pulses CRQ1–CRQ4 of the corresponding channels are selected and multiplexed and thereafter are provided on a single line 88. In a case where any of the note clock pulses CRQ1–CRQ4 having a certain pulse width is selected, it is preferable that after it is selected once at rising of this pulse in response to the pulse CHP1–CHP4, the sustain portion of this pulse should not be selected so that the note clock pulses CRQ1–CRQ4 are time division multiplexed in a differentiated state.

OCT1–OCT4 are octave codes representing octaves of tones to be generated in the respective channels and these octave codes are applied in parallel to a time division control circuit 89. This time division control circuit 89, like the time division control circuit 87, time division multiplexes the cotave codes OCT1–OCT4 for the respective channels in response to the channel timing pulses CHP1–CHP4.

The note clock pulses on the line 88 are applied to an address signal generation circuit 90. The address signal generation circuit 90 counts the applied note clock pulses channel by channel on a time shared basis and generates an addres signal which changes in accordance with timing of generation of these note clock pulses. The generated address signal is applied to an octave shift circuit 91 in which the address signal of the corresponding channel is bit-shifted in response to the octave codes for the respective channels supplied in time division from the time division control circuit 89.

The integer section of the address signal from the shift circuit 91 is supplied to a tone generator 92 in which tone waveshape amplitude signals of sample points corresponding to the value of the integer section are generated. The decimal section of the address signal is applied through a delay circuit 93 to pitch synchronization and interpolation circuits 94-1 through 94-4. The delay circuit 93 is provided for effecting a delay corresponding to a signal delay time between input and output signals in the tone generator 92.

The pitch synchronization and interpolation circuits 94-1 through 94-4 are provided in parallel for the respective channels. In the figure, a specific example of the circuit 94-1 for the channel 1 only is illustrated but the other circuits 94-2 through 94-4 for the other channels are of the same construction as the circuit 94-1 except that the timing pulses CHP1–CHP4, the note clock pulses, i.e., the address change request signals CRQ1–CRQ4 and the pitch synchronization change pulses CHANG1–CHANG4 differ from one another depending upon the channel.

In the pitch synchronization and interpolation circuit 94-1, the tone waveshape sample point amplitude signal generated in time division by the tone generator 92 is applied to a latch circuit 95 and the signal corresponding to the channel 1 is latched in the latch circuit 95 corresponding to the channel 1 in response to the channel timing pulse CHP1. The decimal section data of the address signal delivered through the delay circuit 93 is applied to a latch circuit 96 and data corresponding to the channel 1 is latched in the latch circuit 96 in response to the pulse CHP1. These latch circuits 95 and 96 are provided for releasing the time division multiplexed state.

The output of the latch circuit 95 is applied to a latch circuit 97. The output of the latch circuit 97 is applied to an interpolation circuit 98 as the tone waveshape amplitude signal S1 of the present sample point and also to a latch circuit 99. The output of the latch circuit 96 is applied to a latch circuit 100 and the output of the latch circuit 100 in turn is applied to the interpolation circuit 98 as the interpolation address data INT. The latch circuit 100 is latch controlled by the note clock pulse, i.e., the address change request signal CRQ1. The latch circuits 97 and 99 are latch controlled by the pitch synchronization change pulse CHANG1.

The pitch synchronization change pulses CHANG-1–CHANG4 corresponding to the respective channels are obtained by frequency-dividing the note clock pulses CRQ1–CRQ4 by variable frequency-dividing circuits 101–104 at frequency dividing ratios corresponding to the octave codes OCT1–OCT4. These frequency dividing ratios are determined in relation to the shift amount in the octave shift circuit 91. By way of example, the octave shift circuit 91 is operated in such a manner that no shifting of the address signal is performed when the octave designated by the octave code is the predetermined reference octave, the address signal is shifted up by the number of bits corresponding to an oactave difference when the designated octave is higher than the reference octave, and the address signal is shifted down by the number of bits corresponding to an octave difference when the designated octave is lower than the reference octave. For example, in the case where the address signal is not shifted, i.e., in the case of the reference octave, all bits of the address signal generated in the address signal generation circuit 90 are supplied to the tone generator 92 as the integer section data. In this case, the timing of change of the integer section of the address signal corresponds to the timing of change of the note clock pulses, i.e., the address change request signals CRQ1–CRQ4 (though the timing does not completely synchronize with the change of the note clock pulses since it is time division controlled by the time division control circuit 87). In the case where the address signal is shifted up, all bits of the address signal are supplied to the tone generator 92 as the integer section data in a state in which these bits are multiplied by $2^n$ (n representing the shift amount). In this case, more significant bits exceeding the bit number of the integer section data are discarded. In this case also, the timing of change of the address signal corresponds to the timing of change of the note clock pulses, i.e., the address change request signals CRQ1–CRQ4. On the other hand, in the case where the address signal is shifted down, a part of more significant bits of the address signal are applied to the tone generator 92 as the integer section data and less significant bits are applied to the delay circuit 93 as the decimal section data and supplied through the latch circuits 96 and 100 to the interpolation circuit 98 as the interpolation address data INT. In this case, the timing of change of the integer section of the address signal applied to the tone generator 92, i.e., the timing of change of the sample point amplitude signal generated by the tone generator 92, does not correspond to the timing of change of the note clock pulse, i.e., the address change request signals CRQ1–CRQ4 but changes in accordance with the shift amount n at a period which is $2^n$ times as long as the note clock pulse (in this case too, the change does not take place in synchronism with the change of the note clock pulse). The frequency dividing circuits 101–104 are provided for generating the pitch synchronization change pulses CHANG1–CHANG4 which correspond to the above described timing of change of the integer section of the address signal, i.e., the timing of change of the tone waveshape sample point signal generated by the tone generator 92, and are synchronized with the note clock pulses, i.e., the address change request signals CRQ1–CRQ4.

More specifically, if the octave designated by the octave codes OCT1–OCT4 is higher than the reference octave, the frequency dividing circuits 101–104 deliver out the applied note clock pulses CRQ1–CRQ4 directly as the pitch synchronization change pulses CHANG1–-CHANG4 without applying the frequency division, setting the frequency dividing ratio at 1/1 whereas if the octave is lower than the reference octave, these circuits 101–104 frequency-divide the applied note clock pulses CRQ1–CRQ4 setting the frequency dividing ratio at $1/2^n$ (n being the octave difference) and deliver out the frequency-divided outputs as the pitch synchronization change pulses CHANG1–CHANG4.

By controlling the latch circuits 97 and 99 by this pitch synchronization change pulse CHANG1, the present sample point tone waveshape amplitude signal S1 is latched in the latch circuit 97 in synchronism with this pitch and the preceding sample point tone waveshape amplitude signal S2 is latched in the latch circuit 99 in synchronism with the pitch. Further, by controlling the latch circuit 100 by the note clock pulse CRQ1, the decimal section data of the address signal, i.e., the interpolation data INT, is latched in the latch circuit 100 in synchronism with the pitch of the generated tone.

In the foregoing manner, the amplitude signals S1 and S2 of the two adjacent sample points and the interpolation address data INT applied to the interpolation circuit 98 are all synchronized with the pitch of the tone to be generated so that frequencies of the tone waveshape sampling frequency and the frequency of the interpolation step are harmonized with the tone pitch and the likelihood of generation of inharmonic noise therefore is eliminated. The interpolation circuit 98 is of the same construction as the previously described interpolation circuit 63, interpolating the amplitude value between the two adjacent sample points in response to the interpolation address data INT.

The tone waveshape sample point amplitude signals generated by the pitch synchronization and interpolation circuits 94-1 through 94-4 are added together in an addition circuit 105 and supplied to a sound system through a digital-to-analog converter (not shown).

For the same reason that no particular pitch synchronizing operation is conducted in the circuit of FIG. 6 for the amplitude signal S1 of the present sample point, the latch circuit 97 for the pitch synchronization in FIG. 9 may be omitted.

In the embodiment shown in FIG. 1, the pitch synchronization and interpolation circuit 18 shown in FIG. 6 may be substituted by the pitch synchronization and interpolation circuits 94-1 through 94-4 for the respective channels having the time division releasing latch circuit as shown in FIG. 9.

If the interpolation operation is performed in a state released from the time division multiplexed state as in the pitch synchronization and interpolation circuits 94-1 through 94-4, an analog type interpolation circuit may be employed as the interpolation circuit 98. This is achieved by converting the output of the tone generator 92 to an analog signal, holding the converted signal for the respective channels by a suitable holding means such as a capacitor and applying the output of the holding means to an analog interpolation circuit including a resistance divided circuit.

In the embodiment of FIG. 1, the note clock generation circuit 15 is not limited to the circuit performing the time division operation among the plural channels as shown in FIG. 3 but may be separate circuits provided independently for the respective channels as the note clock generation circuits 86-1 through 86-4.

For having the effective sampling frequency of the tone signal synchronized with the pitch, the pitch synchronization is achieved in the above described embodiments by generating the note clock pulse by the note clock generation circuit, forming the pitch synchronization change pulse in accordance with the note clock pulse and resampling, in response to the pitch synchronization change pulse, the tone waveshape sample point amplitude signals for the respective channels generated on a time shared basis in synchronism with the time division timing which is not synchronized with the pitch. The pitch synchronization, however, may be realized in other manners. For example, the pitch synchronization may be realized by shifting a tone waveshape sample point amplitude signal of a certain time division channel to a time slot of another channel for pitch synchronization and adding this shifted signal to a tone waveshape sample point amplitude signal of that channel.

In the above described embodiment, the interpolation is effected between two adjacent sample points. The interpolation, however, may be performed between skipped sample points or between three or more sample points.

In the above described embodiments, the tone range is determined on the basis of one octave unit and the interpolation processings are performed in correspondence to the tone range thus determined on the basis of one octave unit. The invention, however, is not limited to this but the tone range may be determined on the basis of any octave unit, such as two octave units or a half octave unit.

The number of note names of the note clock pulses which can be generated in the note clock generation circuits 15 and 86-1 through 86-4 in the above described embodiments is not limited to twelve note names within one octave but it may be one corresponding to relative note names (e.g., twentyfour note names within two octaves) in a suitable octave range (e.g., a tone range of two octave units).

In the above described embodiments, the interpolation of amplitude values between sample points is performed in accordance with the octave of a tone to be generated. Alternatively, the interpolation may be performed constantly regardless of the tone range. In a case where the interpolation is performed in accordance with the octave of a tone to be generated, waveshape resolution can be improved depending upon the octave of the tone to be generated whereby an aliasing noise in a lower tone range for example can be eliminated as described in the foregoing and the quality of the generated tone can thereby be improved. In a case where the interpolation is performed regardless of the tone range, waveshape resolution can be improved in any tone range and, accordingly, even if a tone signal has been generated with a relatively coarse sampling interval by a tone generator of a relatively simple construction, the sampling interval of the finally generated tone can be made finer and the quality of the generated tone can thereby be improved.

In sum, according to the invention, interpolation is performed in accordance with the tone range of a tone to be generated so that decrease in the effective sampling frequency in a lower tone range can be prevented and occurrence of an aliasing noise can therefore be eliminated.

Further, according to the invention, the circuit construction can be simplified by generating tone signals in plural channels on a time shared basis and besides the problem of the aliasing noise can be solved by causing the pitch of a tone signal generated in each channel and the sampling frequency to be synchronized with each other. In addition, by interpolating the tone waveshape amplitudes between sample points at a timing synchronized with the pitch of the tone, the quality of the generated tone can be improved and inharmonic noise which tends to be produced by interpolation can be eliminated.

We claim:

1. A tone signal generation device comprising:

phase information generation means for generating phase information representing progressive portions of a tone signal to be generated and corresponding to a tone pitch of said tone signal;

waveshape generation means for generating a tone waveshape in the form of amplitude sampled values in response to said phase information; and interpolation means for interpolating at least two of said amplitude sampled values and for outputting an interpolated result as a new sampled value constituting a part of said tone signal, said interpolation means including means for increasing the fineness of the interpolation as said tone pitch becomes lower.

2. A tone signal generation device as defined in claim 1 wherein said interpolation means performs an interpolation operation only when said tone pitch is lower than a predetermined reference tone pitch.

3. A tone signal generation device as defined in claim 1 wherein the interpolation means includes means for providing plural different interpolated results as new sampled values, wherein the number of new sampled values which are provided increases as an interpolation operation becomes finer.

4. A tone signal generation device as defined in claim 2 wherein said waveshape generation means skips over at least one of said amplitude sampled values only when said tone pitch is higher than said reference tone pitch.

5. A tone signal generation device as defined in claim 1 wherein said interpolation means performs said finer interpolation as a tone range to which said tone pitch belongs becomes lower.

6. A tone signal generation device as defined in claim 5 wherein each tone range includes one octave.

7. A tone signal generation device comprising:

note clock generation means for generating note clock pulses having a frequency corresponding to a note name of a tone signal to be generated;

rate data generation means for generating rate data whose value represents a tone range to which said tone signal belongs;

address signal generation means for processing said rate data at the timing of generation of said note clock pulse to generate an address signal having an integer section and a decimal section;

waveshape generation means for generating a tone waveshape in the form of amplitude sampled values in response to the integer section of said address signal; and interpolation means for interpolating at least two of said amplitude sampled values in accordance with the decimal section of said address signal.

8. A tone signal generation device as defined in claim 7 wherein said rate data corresponds to the difference between the tone pitch of the tone signal to be generated and a predetermined reference tone pitch.

9. A tone signal generation device comprising:

tone generation means for generating tone waveshape sample point amplitude signals in plural channels on a time shared basis;

pitch synchronizing means for synchronizing timing of change of the tone waveshape sample point amplitude signal generated in each channel with the pitch of a tone to be generated in that channnel; and interpolation means for interpolating the tone waveshape sample point amplitude signal of each channel having been synchronized by said pitch synchronizing means between at least two sample points in the same channel at a timing synchronized with the pitch of the tone to be generated in the channel.

10. A tone signal generation device as defined in claim 9 wherein said pitch synchronizing means comprises:

note clock generation means for generating, for each channel, note clock pulses having a frequencey corresponding to the note name of a tone to be generated;

pitch synchronization change pulse generation means for generating, for each channel, a pitch synchronization change pulse in synchronism with one or more periods of the note clock pulses; and means for sampling the tone waveshape sample point amplitude signal of each channel generated by said tone generation means in response to the pitch synchronization change pulse corresponding to that channel.

11. A tone signal generation device as defined in claim 9 which further comprises interpolation variable supply means for supplying, responsive to the note clock pulses having a frequency corresponding to a tone to be generated, interpolation variable data which changes in synchronism with the note clock pulses during the time between sample points to be interpolated, said interpolation means performing an interpolation in response to said interpolation variable data.

12. A tone signal generation device as defined in claim 9 wherein said pitch synchronizing means comprises:

means for generating, for each channel on a time shared basis, note clock pulses having a frequency corresponding to the note name of a tone to be generated in the channel;

means for providing change rate data corresponding to the octave of a tone to be generated in each channel;

means for generating, for each channel, an address signal which includes an integer section by counting the change rate data in response to the note clock pulses;

means for generating a pitch synchroniztion change pulse in response to a timing at which an integer section of the address signal is to be changed; and means for sampling the tone waveshape sample point amplitude signal of each channel generated by said tone generation means in response to the pitch synchronization change pulse.

13. A tone signal generation device comprising:

phase information generating means for generating phase data representing progressive portions of a tone signal to be generated, said phase information corresponding to the pitch of the tone signal;

waveshape generation means for generating a tone waveshape comprised of amplitude sample values in response to said phase information; and interpolation means for interpolating at least two of said amplitude sample values to provide at least one new sample value to form a part of said tone waveshape, said interpolation means providing a larger number of new sample values as a result of the interpolation of said at least two amplitude sample values for tone waveshapes of relatively low pitch as compared to tone waveshapes of relatively higher pitch.

* * * * *

UNITED STATES PATENT AND TRADEMARK OFFICE

CERTIFICATE OF CORRECTION

PATENT NO. : 4,719,833

DATED : Jan. 19, 1988

INVENTOR(S) : Mitsumi Katoh; Tokuji Hayakawa

It is certified that error appears in the above-identified patent and that said Letters Patent is hereby corrected as shown below:

On the title page Insert

--(30) Foreign Application Priority Data

| | | |
|---|---|---|
| April 12, 1985 (JP) | Japan | 77979/1985 |
| April 16, 1985 (JP) | Japan | 79361/1985 --. |

Signed and Sealed this

Thirtieth Day of August, 1988

*Attest:*

DONALD J. QUIGG

*Attesting Officer*

*Commissioner of Patents and Trademarks*